US005506600A

United States Patent [19]

Ooki et al.

[11] Patent Number: 5,506,600

[45] Date of Patent: Apr. 9, 1996

[54] DRIVING APPARATUS

[75] Inventors: Akiko Ooki, Atsugi; Akira Tsuboyama, Sagamihara; Hiroshi Inoue, Yokohama, all of Japan

[73] Assignee: Canon Kabushiki Kaisha, Tokyo, Japan

[21] Appl. No.: 339,299

[22] Filed: Nov. 10, 1994

Related U.S. Application Data

[63] Continuation of Ser. No. 34,659, Mar. 22, 1993, abandoned, which is a continuation of Ser. No. 427,566, Oct. 27, 1989, abandoned.

[30] Foreign Application Priority Data

Oct. 28, 1988 [JP] Japan ..... 63-274016

[51] Int. Cl.[6] ..... G09G 3/36

[52] U.S. Cl. ..... 345/101; 345/100

[58] Field of Search ..... 358/241; 345/55, 345/87, 94, 100, 101

[56] References Cited

U.S. PATENT DOCUMENTS 4,462,027 7/1984 Lloyd ..... 340/784
4,701,799 10/1987 Yoshimura ..... 358/241
4,902,107 2/1990 Tsuboyama et al. ..... 340/784 X
4,923,285 5/1990 Ogino et al. ..... 350/331 T
4,962,376 10/1990 Inoue et al. ..... 350/331 T X
5,091,723 2/1992 Kanno et al. .

OTHER PUBLICATIONS

L. E. Tannas, Jr., *Flat-Panel Displays and CRTs,* Van Nostrand Reinhold Company, New York, 1985, pp. 4–5.

*Primary Examiner*—Ulysses Weldon
*Attorney, Agent, or Firm*—Fitzpatrick, Cella, Harper & Scinto

[57] ABSTRACT

In a driving apparatus comprising:

a. a control for driving matrix electrodes having scanning and information electrodes;

b. a counter for counting the number of scanning electrodes to which a scanning selection signal is applied; and c. a control for designating a width of a scanning selection period for every predetermined count value.

14 Claims, 18 Drawing Sheets

| FIG. 2A | FIG. 2B | FIG. 2C |
|---|---|---|

| FIG. 4A | FIG. 4B | FIG. 4C |
|---|---|---|

(CONTROLLER 500 AND GATE ARRAY 680)
DACT
605
611
DACT GENERATOR
FEN GENERATOR
IRQ GENERATOR
603
A/D
CLK
DATA INPUT UNIT
601
D0~D3
RND
BUSY
CLK
D
LINK TO WORD PROCESSOR BODY 1
IRQ
FEN
DS0~DS1
TO FIG. 4C
LATH
650
DECODER
CS0~CS7
CA0~CA6
675
MPX 11
MPX 12
MPX 13
MPX 14
MPX 15
MPX 16
MPX 17
MPX 18
CCLR
CEN
CM1
CM2
SCLR
SEN
SM1
SM2
FROM FIG. 4A
TO FIG. 4C
677
MPX MPX MPX MPX MPX MPX

DRIVING APPARATUS

This application is a continuation of application Ser. No. 08/034,659 filed Mar. 22, 1993, now abandoned, which is a continuation of application Ser. No. 07/427,566 filed Oct. 27, 1989, now abandoned.

BACKGROUND OF THE INVENTION

1. Field of the Invention

The present invention relates to a liquid crystal apparatus or a driving apparatus using a ferroelectric liquid crystal material and, more particularly, to a liquid crystal apparatus or a driving apparatus which can suppress a flicker generated in a display drive operation at a low temperature.

2. Related Background Art

In a known liquid crystal display element, scanning electrodes and signal electrodes are arranged in a matrix, and a liquid crystal compound is filled between these electrodes to form a large number of pixels so as to display an image or information. As a method of driving the display element, a time-divisional driving method is adopted. In this method, address signals are sequentially, periodically, and selectively applied to the scanning electrodes, and a predetermined information signal is parallelly and selectively applied to the signal electrodes in synchronism with the address signals.

Most of commercially available liquid crystal display elements are TN (Twisted Nematic) liquid crystal described in, e.g., M. Schadt and W. Hellrich, "Voltage Dependent Optical Activity of a Twisted Nematic Liquid Crystal", Applied Physics Letters, 1971, Vol. 18(4), pp. 127 to 128.

In recent years, as an improved conventional liquid crystal element, a liquid crystal element having bistability is proposed in, e.g., Japanese Patent Laid-Open (Kokai) No. 56-107216, U.S. Pat. No. 4,367,924, and the like by Clark and Lagerwall. As a bistable liquid crystal, a ferroelectric liquid crystal having a chiral smectic C phase (SmC*) or H phase (SmH*) is used. In the C or H phase state, the ferroelectric liquid crystal takes a first or second optically stable state in response to an applied electric field, and maintains the state when no electric field is applied. That is, the ferroelectric liquid crystal has bistability, and is expected to be widely used in the field of high-speed storage type display apparatuses having a quick response property with respect to a change in electric field.

The ferroelectric liquid crystal element is driven by driving apparatuses disclosed in, e.g., U.S. Pat. Nos. 4,548,476, 4,655,561, 4,697,887, 4,709,995, 4,712,872, and the like.

However, threshold characteristics of a ferroelectric liquid crystal largely depend on an external temperature, as shown in FIG. 10. More specifically, as a temperature becomes lower, an applied voltage necessary for inversion is increased and a voltage application time is prolonged.

Therefore, a ferroelectric liquid crystal must increase a drive pulse width (scanning selection period) in a driving operation at a low temperature as compared to a scanning driving operation at a frame frequency of 15 Hz at a high temperature. The ferroelectric liquid crystal requires a scanning driving operation at a low frame frequency of, e.g., 5 to 10 Hz. For this reason, in a driving operation at a low temperature, a flicker caused by the scanning driving operation at a low frame frequency occurs.

SUMMARY OF THE INVENTION

It is an object of the present invention to provide a liquid crystal apparatus and a driving apparatus which can realize a display driving operation over a wide temperature range. It is another object of the present invention to provide a liquid crystal apparatus and a driving apparatus which can suppress generation of a flicker over a wide temperature range and can realize high-quality display.

According to the first characteristic feature of the present invention, there is provided a driving apparatus comprising:

a. means for driving matrix electrodes having scanning and information electrodes;

b. means for counting the number of scanning electrodes to which a scanning selection signal is applied; and c. means for designating a width of a scanning selection period in accordance with an external temperature at every predetermined count.

According to the second characteristic feature of the present invention, there is provided a driving apparatus comprising:

a. first means for driving matrix electrodes having scanning and information electrodes;

b. second means for counting the number of scanning electrodes to which a scanning selection signal is applied; and c. third means for designating a width of a scanning selection period in accordance with an external temperature at every predetermined count, and decreasing the predetermined count in accordance with a decrease in external temperature.

According to the third characteristic feature of the present invention, there is provided a liquid crystal apparatus comprising:

a. a liquid crystal element having matrix electrodes having scanning and information electrodes and a ferroelectric liquid crystal;

b. driving means comprising means for applying a scanning selection signal to the scanning electrodes, and means for applying an information signal in synchronism with the scanning selection signal; and c. control means for counting the number of scanning electrodes to which the scanning selection signal is applied, and controlling the driving means so that a width of the scanning selection signal is set for every predetermined count to be a width of a scanning selection period designated in accordance with an external temperature.

According to the fourth characteristic feature of the present invention, there is provided a liquid crystal apparatus comprising:

a. a liquid crystal element having matrix electrodes having scanning and information electrodes and a ferroelectric liquid crystal;

b. driving means comprising means for applying a scanning selection signal to the scanning electrodes, and means for applying an information signal in synchronism with the scanning selection signal;

c. first control means for counting the number of scanning electrodes to which the scanning selection signal is applied, and controlling the driving means so that a width of the scanning selection signal is set for every predetermined count to be a width of a scanning selection period designated in accordance with an external temperature; and d. second control means for controlling the first control means to decrease the predetermined count in accordance with a decrease in external temperature.

DESCRIPTION OF THE PREFERRED EMBODIMENT

Figure 1:
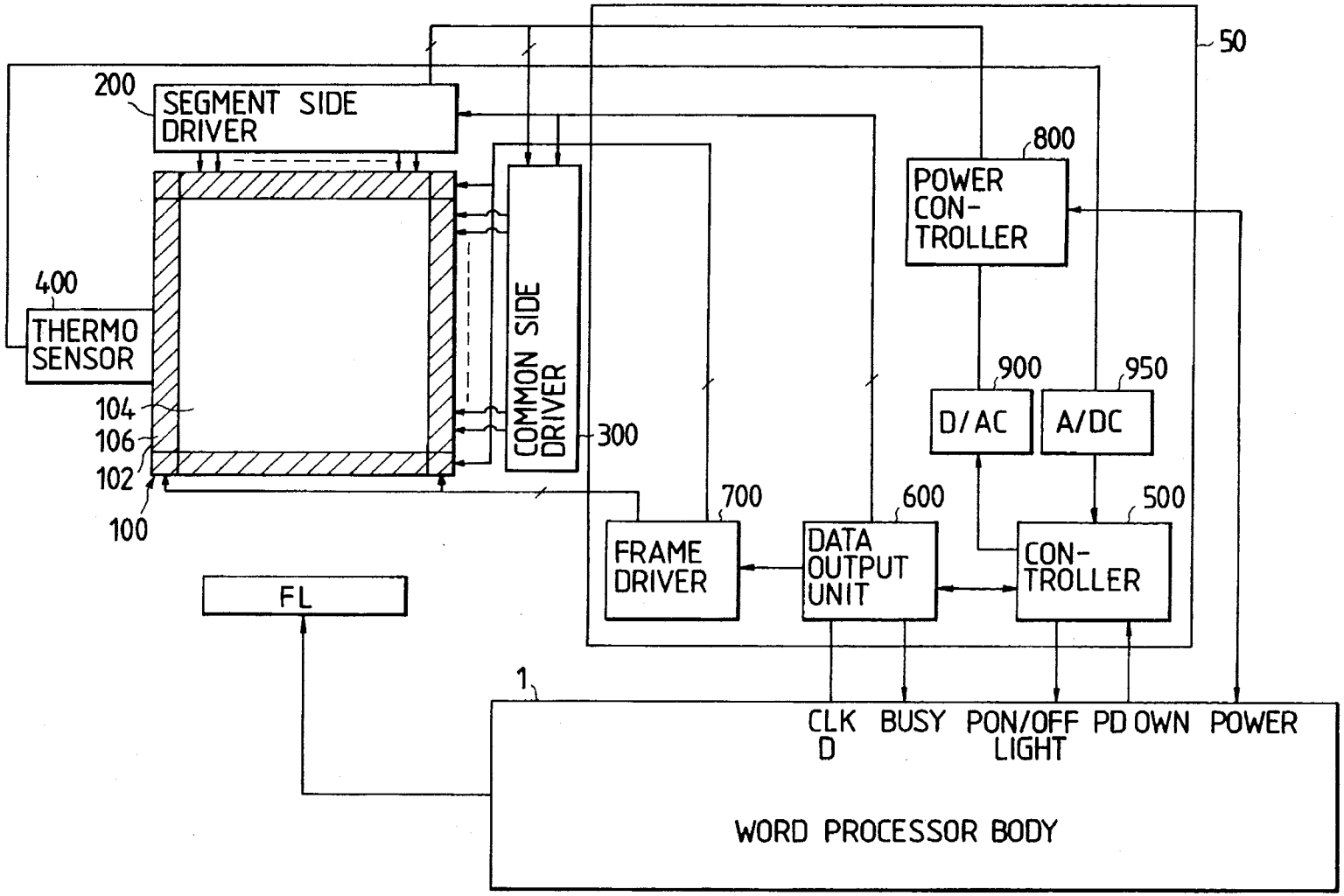
FIG. 1 is a block diagram of an apparatus according to the present invention.

FIG. 1 shows an embodiment of the present invention. A word processor body 1 is a host apparatus serving as a supply source of image data to be displayed to a display according the present invention. A display control apparatus 50 controls a driving operation of the display on the basis of display data supplied from the word processor body 1 in accordance with various conditions (to be described later). A display 100 employs an FCL (ferroelectric liquid crystal). A segment side driver 200 and a common side driver 300 respectively drive information electrodes and scanning electrodes provided to the display 100 in accordance with drive data supplied from the display control apparatus 50, and the like. A thermo sensor 400 is arranged at an appropriate position of the display 100, e.g., a portion at an average temperature.

The display 100 includes a display screen 102, an effective display region 104 on the display screen 102, and a frame 106 provided outside the effective display region on the display screen 102. In this embodiment, electrodes corresponding to the frame 106 are arranged on the display 100, and are driven to form the frame on the screen 102.

Figures 4, 4A:
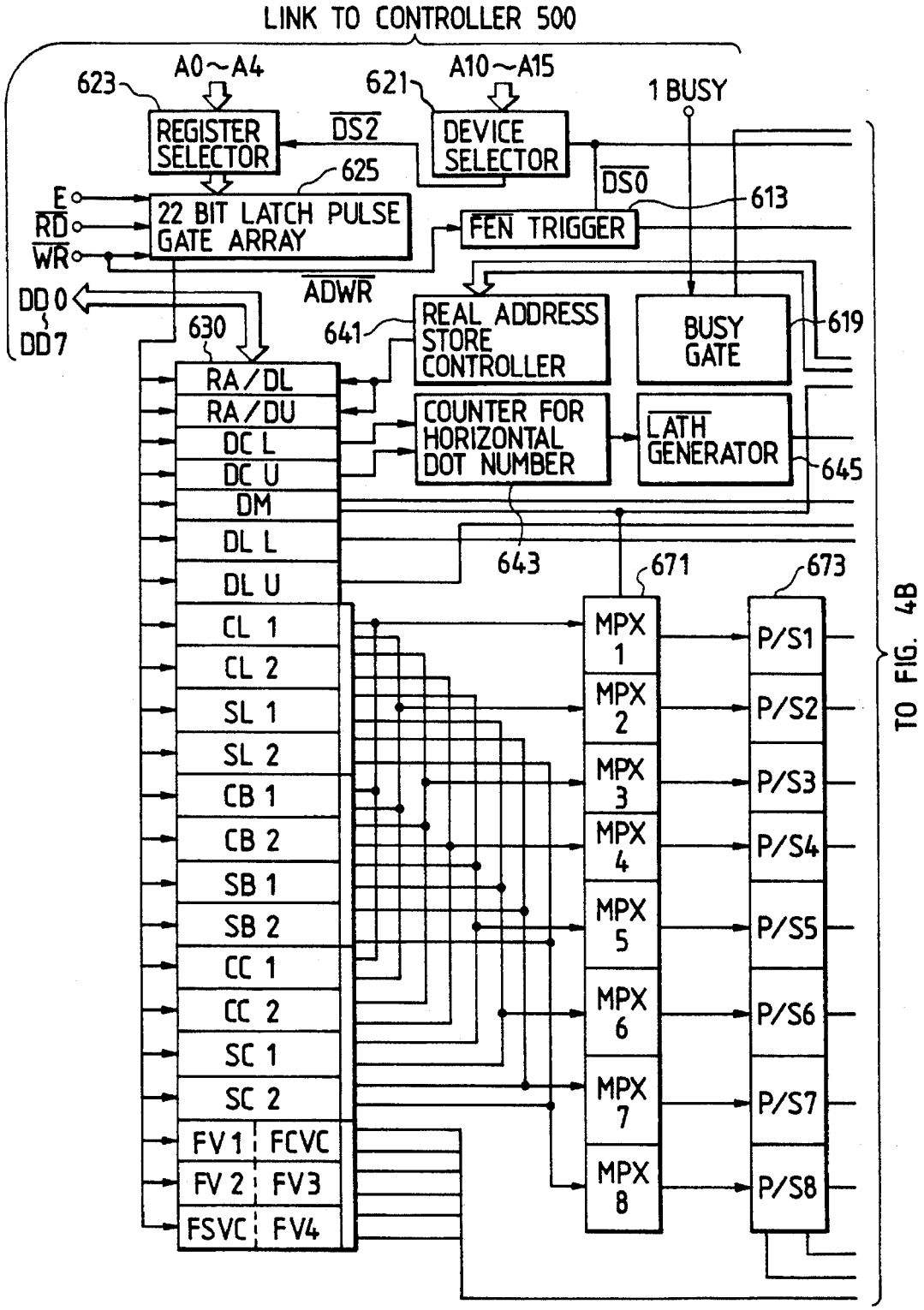
FIGS. 4, 4A, 4B and 4C are block diagrams of a data output unit.
Figure 4B:
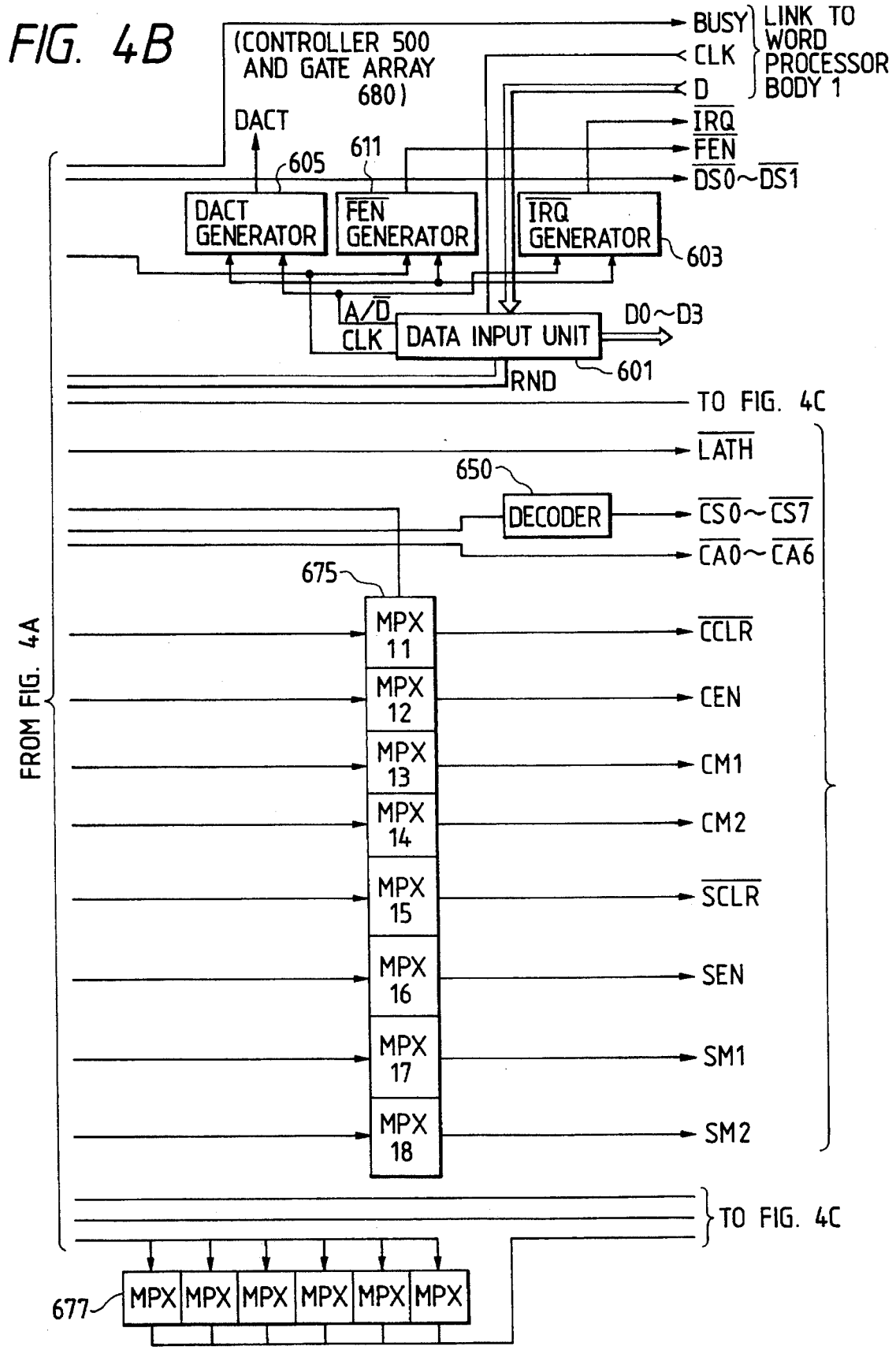
Figure 4C:
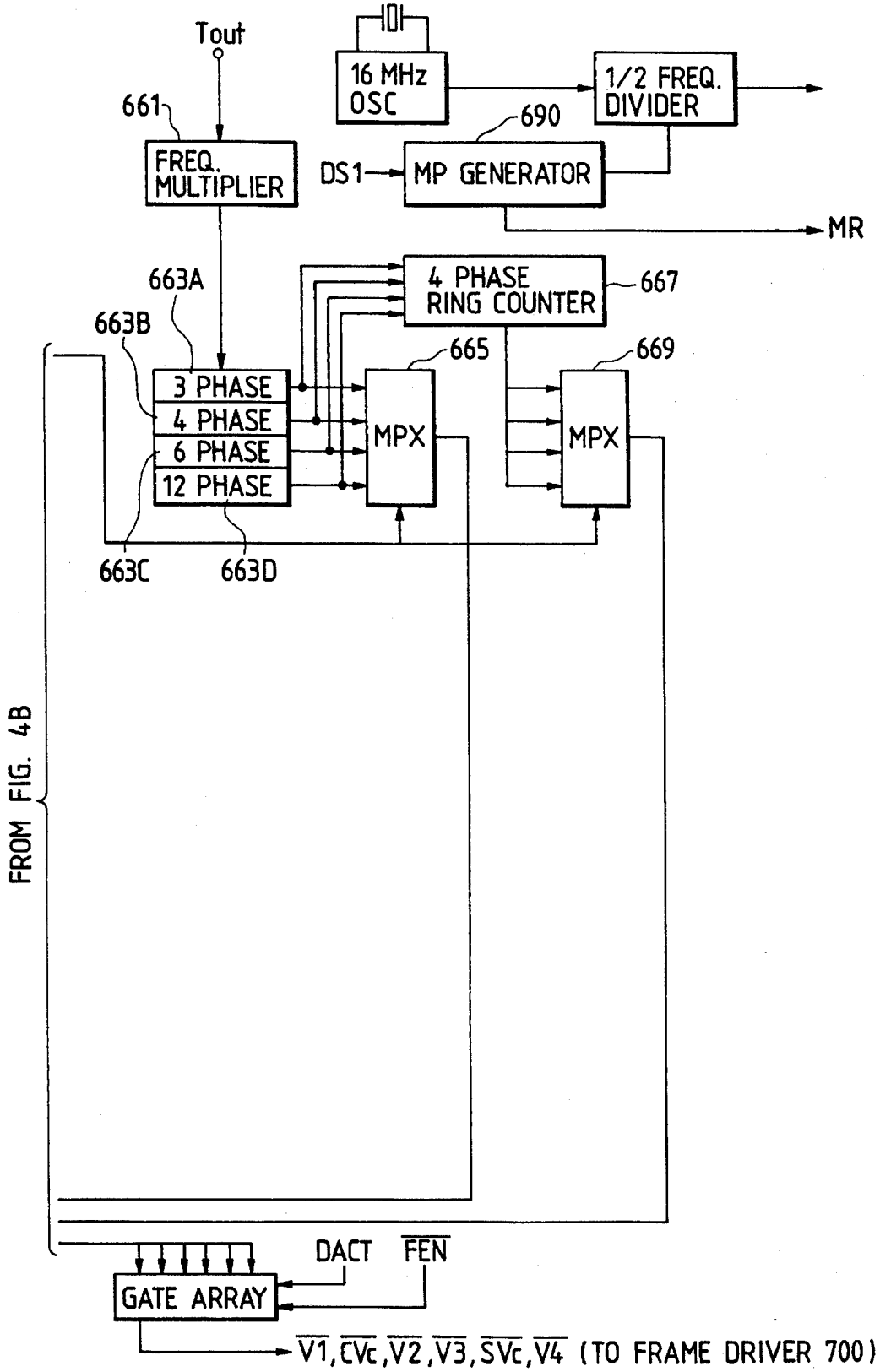

The display control apparatus 50 includes a controller 500 (to be described later with reference to FIGS. 2, 2A, 2B and 2C) for controlling transmission/reception of various data with the display 100 and the word processor body 1, a data output unit 600 (to be described later with reference to FIG. 4) for diving the display drivers 200 and 300 based on display data supplied from the word processor body 1 in accordance with setting data from the controller 500, and driving the drivers to set data for the controller 500, and a frame driver 700 for forming the frame 106 on the display screen 102 on the basis of output data from the data output unit 600.

Figure 7:
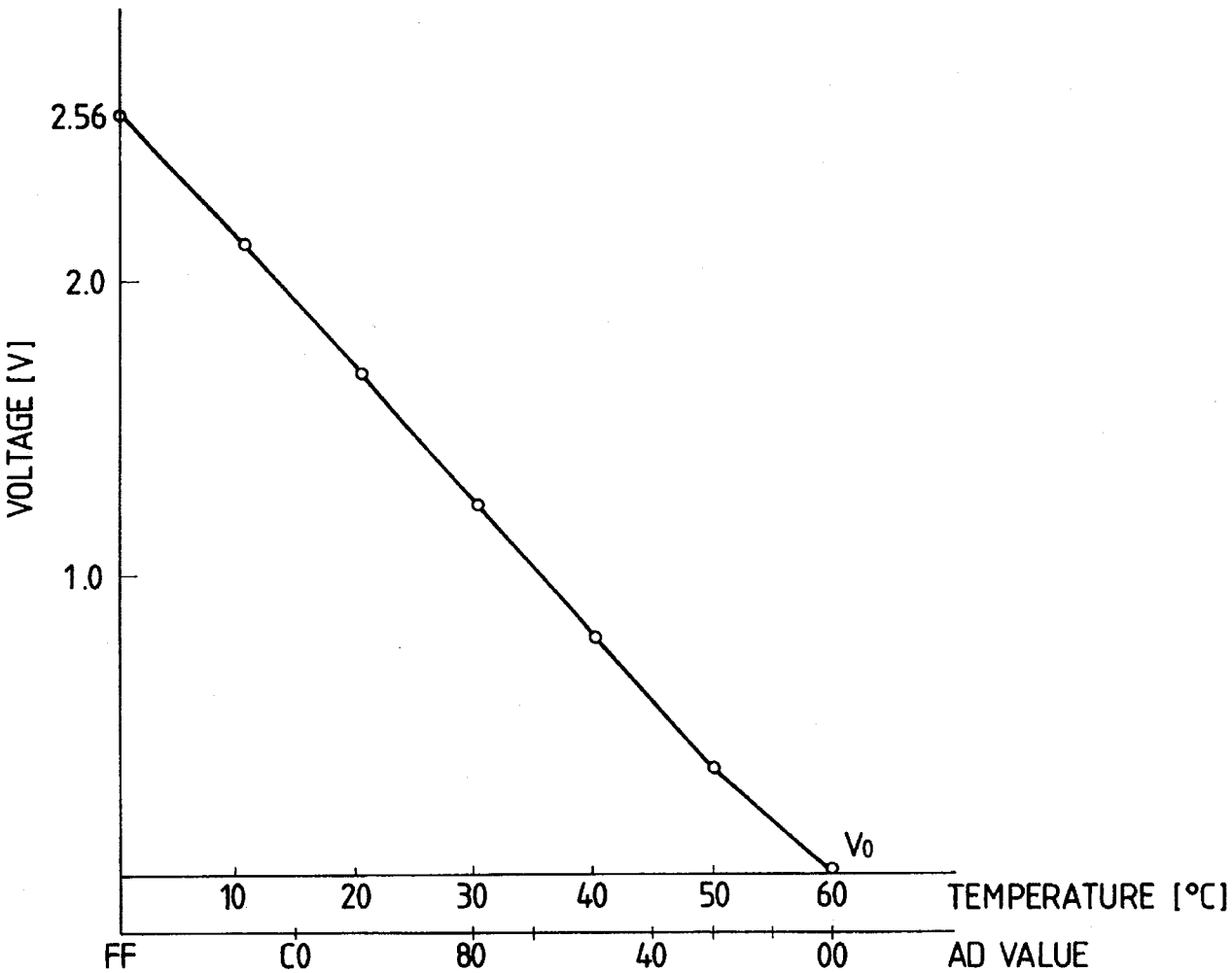
FIG. 7 is a graph showing the relationship between thermistor characteristics and an A/D convertion output.

The display control apparatus 50 also includes a power controller 800 for appropriately changing a voltage signal from the word processor body 1 under the control of the controller 500 to generate a voltage to be applied from the display drivers 200 and 300 to power sources, a D/A converter 900, arranged between the controller 500 and the power controller 800, for converting digital setting data of the controller 500 into analog data and supplying the analog data to the power controller 800, and an A/D converter 950, arranged between the thermo sensor 400 and the controller 500, for converting analog temperature data detected at the display 100 into digital data and supplying the digital data to the controller 500. The output characteristic of thermo-sensor 400, and the corresponding output-count values of the A/D converter 950, are shown in FIG. 7.

The word processor body 1 has a function of a host apparatus serving as a display data supply source to the display 100 and the display control apparatus 50, and may be replaced with another host apparatus, e.g., a computer, an image reader, or the like. In any case, according to this embodiment, the word processor body 1 is assumed to be able to exchange the following data. That is, data to be supplied to the display control apparatus 50 are:

D: Signal including address data for designating a display position of data and a horizontal sync signal. If a host apparatus has a VRAM corresponding to the effective display region 104, it can directly output address data capable of designating a display address (corresponding to a display on the effective display region 104) of image data. In this embodiment, the word processor body 1 superposes this signal on the horizontal sync signal or a blanking signal, and supplies the superposed signal to the data output unit 600.

CLK: Transfer clock of image data PD0 to PD3. The word processor body 1 supplies the clock CLK to the data output unit 600.

PDOWN: Signal for informing that a system power supply is turned off. The word processor body 1 supplies the signal PDOWN to the controller 500 as a non-maskable interrupt (MWI).

Data to be supplied from the display control apparatus to the word processor body 1 are:

P ON/OFF: Status for informing that the display control apparatus 50 completes rise and fall operations respectively when the system power supply is turned on and off. This status is output from the controller 500.

Light: Signal for indicating an ON/OFF operation of a light source FL combined with the display 100. This signal is output by the controller 500.

Busy: Sync signal for causing the word processor body 1 to stand by for a transfer operation of the signal D so that the display control apparatus 50 performs various setting operations during initialization or a display operation. In this embodiment, the word processor body 1 can accept the Busy signal. The Busy signal is supplied from the controller 500 to the word processor body 1 through the data output unit 600.

Signals and data exchanged among respective units are summarized below.

| Signal | Signal Name | Output Side | Input Side | Content |
|---|---|---|---|---|
| Tout | System Clock | Controller 500 | Data Output Unit 600 | Fundamental clock for operation of data |

-continued

| Signal | Signal Name | Output Side | Input Side | Content |
|---|---|---|---|---|
| | | (PORT2) | | output unit 600. This clock synchronizes time on control program and time on display, and is also input to controller 500 to always maintain stable 1 horizontal sync period. |
| $\overline{IRQ1}$ | Line Access Interrupt | Data Output Unit 600 | Controller 500 (PORT5) | One of these interrupt signals is input to controller 500 depending on setting |
| $\overline{IRQ2}$ | Block Access Interrupt | Data Output Unit 600 | Controller 500 (PORT5) | in accordance with interrupt signal IRQ generated by data output unit 600 in accordance with real address data supplied from word processer body 1. |
| MR | Memory Ready | MR Generator | Controller 500 (PORT5) | Signal for controlling access timing of D/A converter 900 |
| $\overline{INTR}$ | A/D Conversion END Acknowledge | A/D Converter 950 | Controller 500 (PORT6) | Signal for acknowledging that A/D conversion of detected temperature data is completed |
| IBUSY | Busy | Controller 500 (PORT6) | Data Output Unit 600 | This Signal is output to data output unit 600 to be acknowledged to word processor body 1 |
| Light | Light Source Control Signal | Controller 500 (PORT6) | Word Processor Body 1 | Requests ON/OFF of light source FL |
| P ON/OFF | Power Status | Controller 500 (PORT6) | Word Processor Body 1 | Requests processing when power source is turned on/off |
| DACT | Panel Access Identification Signal | Controller 500 (PORT6) Data Output Unit 600 (Gate Array 680) | Data Output Unit 600 (DACT Generator) | Signal for identifying access/nonaccess of effective display region 104 |
| $\overline{RD}$ | Read Signal | Controller 500 (PORT7) | A/D Converter 950 Data Output Unit 600 | Control signal for reading out data from respective units at input side |
| WR | Write Signal | Controller 500 (PORT7) | A/D converter 950 D/A converter 900 Data Output Unit 600 | Control signal for loading data at respective units |
| DD0 to DD7 | Data on System Data Bus | Respective Units | Respective Units | |
| A0 to A15 | Address Signal | Controller 500 (PORT1, PORT4) | Data Output Unit 600 | Used for causing data output unit 600 to select respective units |
| $\overline{RES}$ | Reset Signal | Controller 500 (Reset Unit 507) | Controller 500 (CPU 501) | Resets CPU of Controller 500 |
| $\overline{NMI}$ (PDOWN) | Non-Maskable Interrupt (Power-Off Interrupt) | Word Processor Body 1 | Controller 500 (CPU) | Controller 500 performs appropriate processing in accordance with PDOWN to which word processor body 1 acknowledes power-off using PDOWN as $\overline{NMI}$ |
| E | Clock | Controller 500 (CPU) | D/A converter 900 Data Output Unit 600 | Clock which is output while its pulse width is changed by signal MR to appropriately access D/A converter 900 or data output unit 600 |
| D0 to D3 | Image Data | Data Output Unit 600 | Segment Side Driver 200 | Generated by image data input from word processor body 1 as signal D |
| D | | Word Processor Body 1 | Data Output Unit 600 | Signal including data to be displayed, real address data, and horizontal sync signal |
| CLK | Transfer Clock | Word Processor Body 1 | Data Output Unit 600 | Transfer clock for signal D |
| $A/\bar{D}$ | Address/Data Identification Signal | Data Output Unit 600 | Data Output Unit 600 | Signal for identifying whether or not data output as signal D is image data or real address data |
| RA/D | Real Address Data | Data Output Unit 600 (Data Input Unit 601) | Data Output Unit 600 (Register 630) | Added to data to specify display position. Data RA/D corresponds to one line, and is generated from data input from word processer body 1 as signal D to be superposed on horizontal sync signal. |
| IRQ | Interrupt Signal | Data Output Unit 600 | Controller 500 | Supplied to controller 500 side according to signal A/D. Signal IRQ is supplied to controller 500 as IRQ1 or IRQ2 according to setting. |
| IRQ3 | Internal Interrupt | Controller 500 (Timer) | Controller 500 (CPU) | Internal interrupt for canceling non-operation state (sleep state) |
| $\overline{FEN}$ | Frame End Signal | Data Output Unit 600 ($\overline{FEN}$ Generator) | Data Output Unit 600 (Gate Array 680) | Used for lateral frame formation |
| $\overline{DS0}$ | Chip Select Signal | Data Output Unit 600 | A/D Converter 950 | Generated in accordance with signals A10 to A15 from controller 500. These signals serve as chip select signals for respective units when viewed from controller 500. |
| $\overline{DS1}$ | Chip Select Signal | (Device Selector) | D/A Converter 900 | |
| $\overline{DS2}$ | Chip Select | | Data Output Unit 600 | |

-continued

| Signal | Signal Name | Output Side | Input Side | Content |
|---|---|---|---|---|
| | Signal | | (Register Selector) | |
| $\overline{DS3}$ | Chip Select Signal | | Unused | |
| $\overline{LATH}$ | Latch Signal | Data Output Unit 600 | Segment Side Driver 200 (Segment Driving Element 210) | Causes line memory to latch data (image data) in shift register in element 210 |
| CA0 to CA6 | Line Select Signal | Data Output Unit 600 | Common Side Driver 300 (Common Driving Element 310) | Selects signals of horizontal scanning output lines to be supplied to element 310. Signals CA5 and CA6 are used for block selection and signals CA0 to CA4 are used for line selection in blocks |
| $\overline{CCLR}$ | Clear Signal | Data Output Unit 600 | Common Side Driver 300 | |
| CEN | Enable Signal | Data Output Unit 600 | Common Side Driver 300 | |
| CM1, CM2 | Waveform Defining Signal | Data Output Unit 600 | Common Side Driver 300 | Defines output waveforms of common driving element 310 |
| $\overline{SCLR}$ | Clear Signal | Data Output Unit 600 | Segment Side Driver 200 | |
| SEN | Enable Signal | Data Output Unit 600 | Segment Side Driver 200 | |
| SM1, SM2 | Waveform Defining Signal | Data Output Unit 600 | Segment Side Driver 200 | Defines output waveforms of segment driving element 210 |
| $\overline{V1}$ to $\overline{V4}$ | Frame Driver Switch Signal | Data Output Unit 600 | Frame Driver 700 | Defines output from frame driver 700 |
| $\overline{CVc}$, $\overline{SVc}$ | | | | |
| V1, V2 | Voltage Signal | Power Controller 800 | Common Side Driver 300 | Defines output voltage (two values "+" and "−") of element 310 |
| V3, V4 | Voltage Signal | Power Controller 800 | Segment Side Driver 200 | Defines output voltage (two values "+" and "−") of element 210 |
| Vc | Voltage Signal | Power Controller 800 | Drivers 200, 300 | Defines reference ("0") of output voltage |

FIGS. 2, 2A, 2B and 2C show an arrangement of the controller 500. The controller 500 comprises a CPU (microprocessor) 501 for controlling respective units in accordance with a control procedure shown in FIG. 5, a ROM 503 in which various tables shown in FIG. 3 are developed in addition to a program corresponding to the control procedure shown in FIG. 5 to be executed by the CPU 501, and a RAM 505 serving as a work area when the CPU 501 executes the control procedure.

Port units PORT1 to PORT6 can set I/O directions, and respectively have ports P10 to P17, P20 to P27, P30 to P37, P40 to P47, P50 to P57, and P60 to P67. A port unit PORT7 serves as an output port, and has ports P70 to P74. I/O setting registers (data direction registers) DDR1 to DDR6 switch I/O directions of the port units PORT1 to PORT6. In this embodiment, the ports P13 to P17 (corresponding to signals A3 to A7) of the port unit PORT1, the ports P21 to P25 and P27 of the port unit PORT2, the ports P40 and P41 (corresponding to signals A8 and A9) of the port unit PORT4, the ports P53 to P57 of the port unit PORT5, the port P62 of the port unit PORT6, the ports P72 to P74 of the port unit PORT7, and terminals MP0, MP1, and STBY of the CPU 501 are unused.

The controller 500 also comprises a reset unit 507 for resetting the CPU 501, and a clock generator 509 for supplying an operation reference clock (4 MHz) to the CPU 501.

Timers TMR1, TMR2, and SCI respectively have reference clock generation sources and registers, and can frequency-divide the reference clock in accordance with setting to the registers. The timer TMR2 frequency-divides the reference clock in accordance with setting to the register, and generates the signal Tout serving as a system clock of the data output unit 600. The data output unit 600 generates a clock signal for defining one horizontal scanning period (1H) of the display 100 on the basis of the signal Tout. The time TMR1 is used for adjusting an operation time on the program and 1H of the display screen 102, and realizes such adjustment in accordance with a setting value to its register.

These timers TMR1 and TMR2 supply the signal IRQ3 as an internal interrupt signal to the CPU 501 upon time-up of a setting time based on the setting value or at the beginning of the next count operation after time-up, and the CPU 501 accepts this signal as needed.

Note that the timer SCI is not used in this embodiment.

Figures 2, 2A:
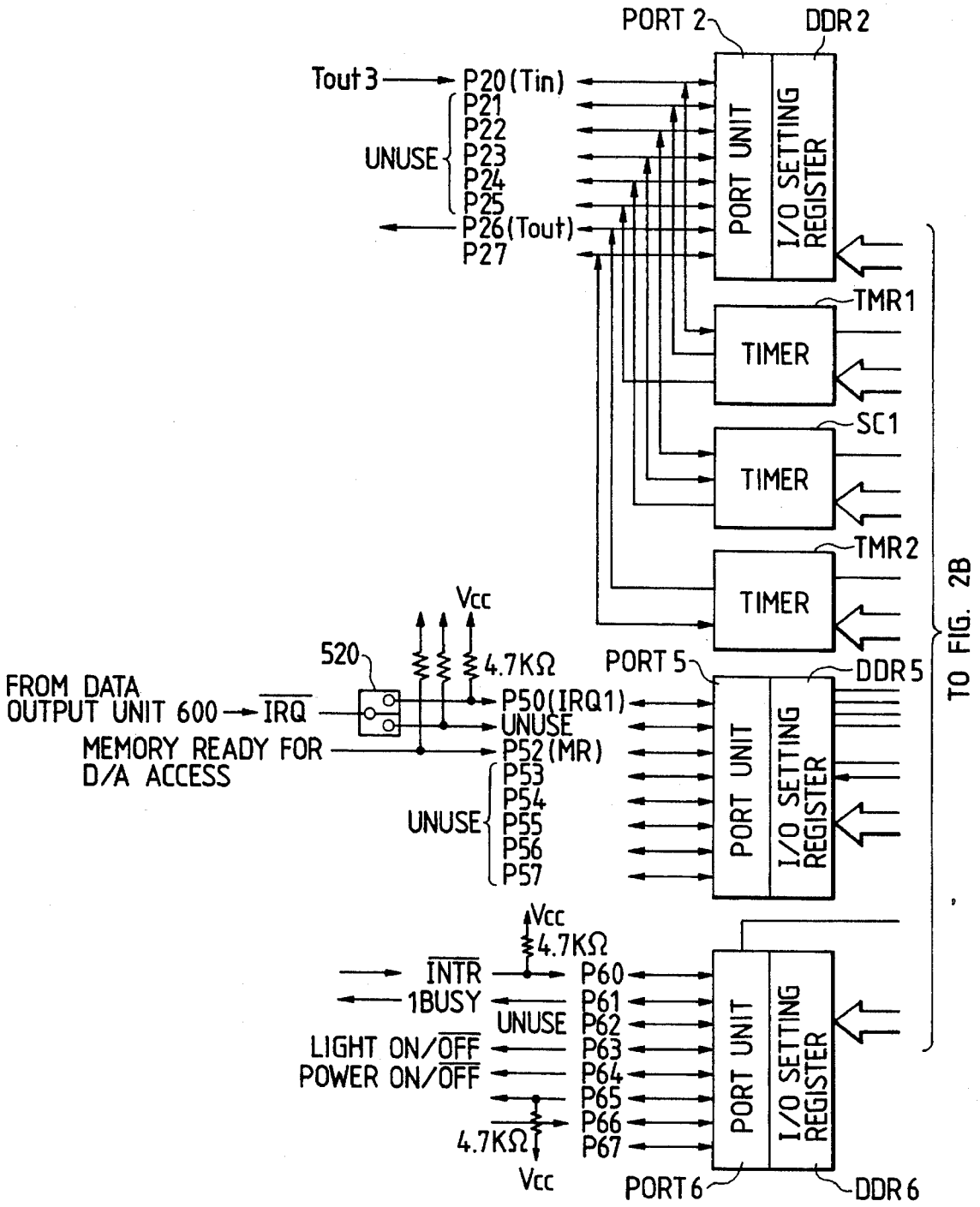
FIGS. 2, 2A, 2B and 2C are block diagrams of a controller used in the present invention.
Figure 2B:
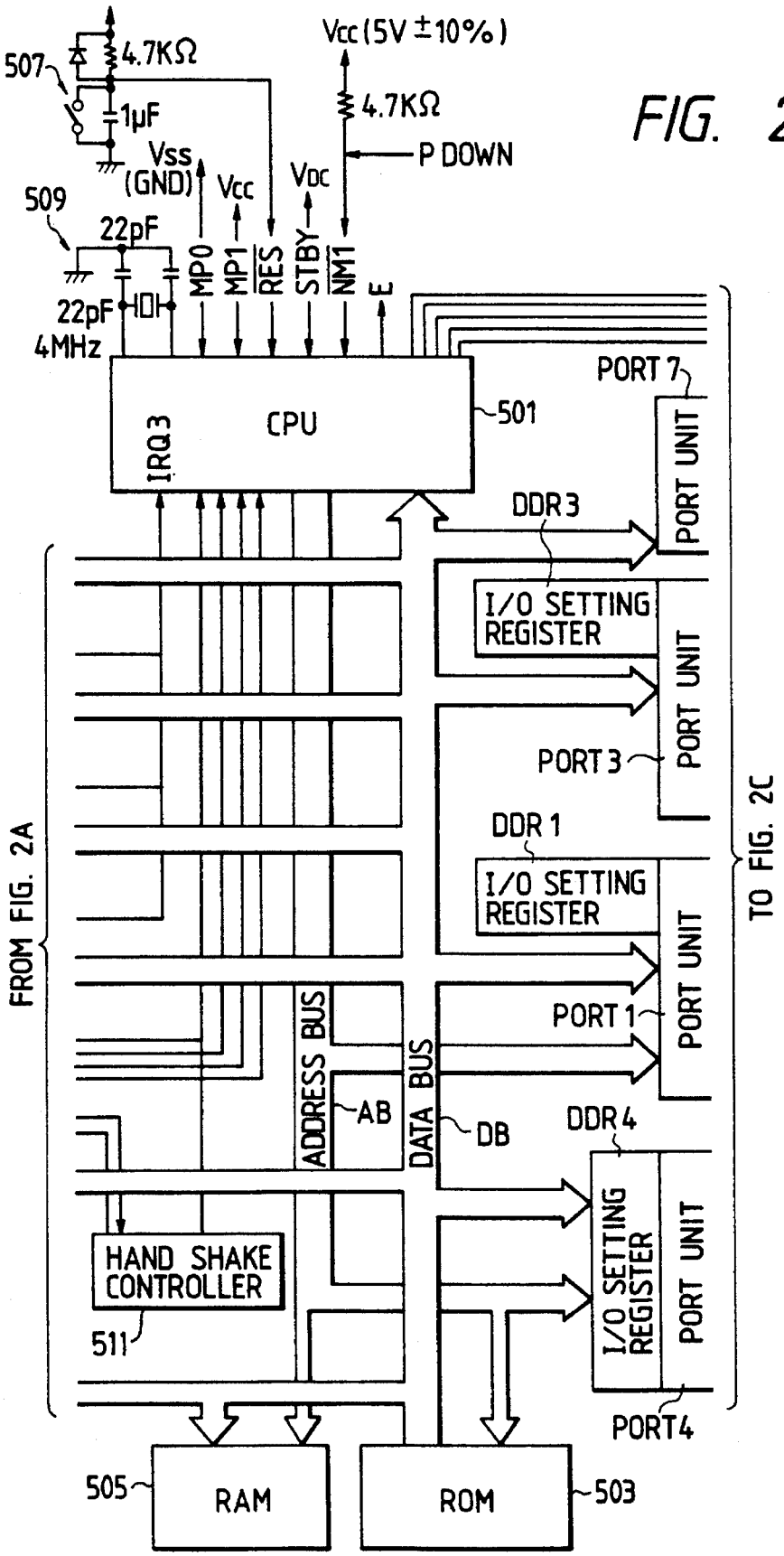
Figure 2C:
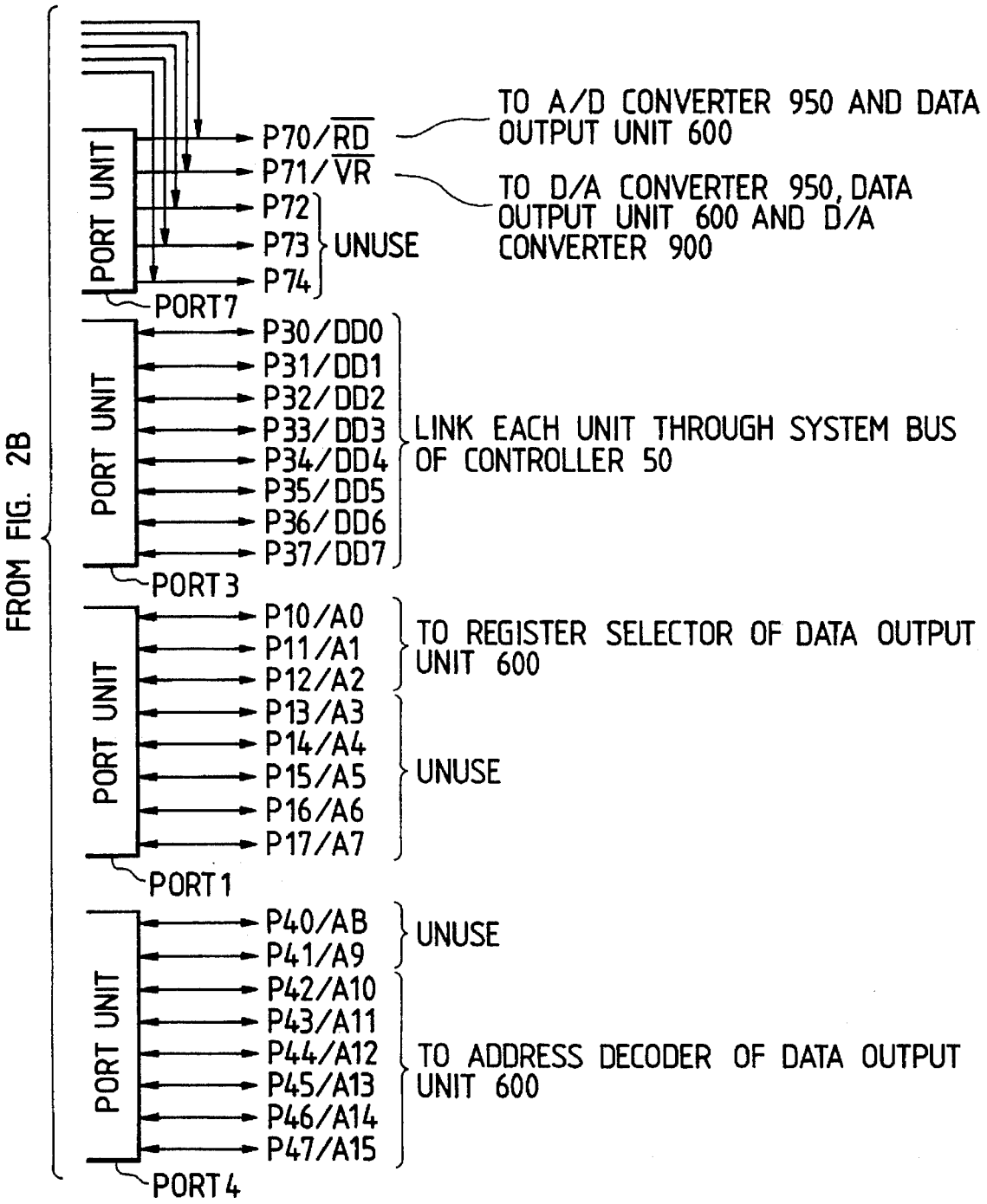
Figure 3:
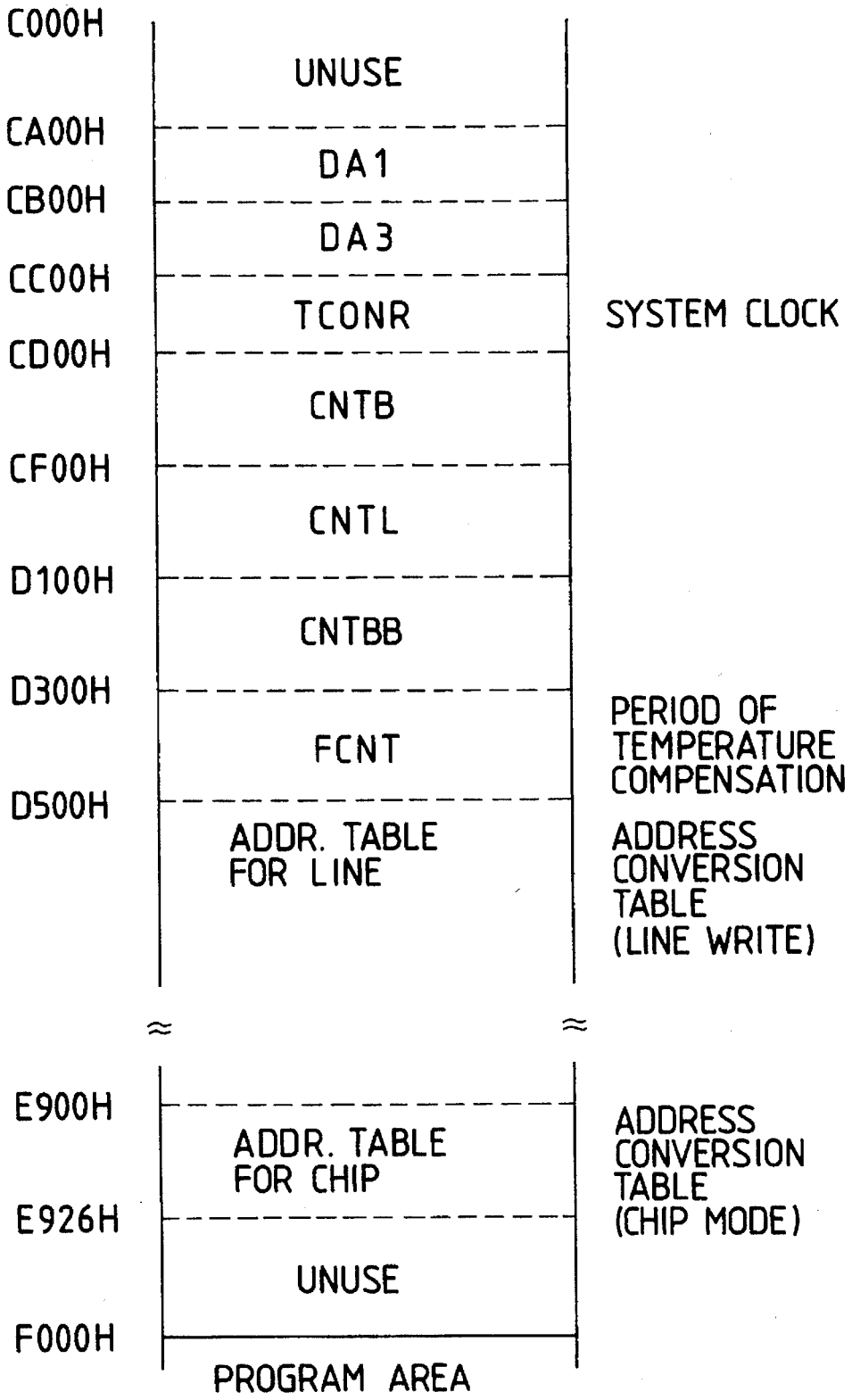
FIG. 3 is a DE chart of a look-up table used in the present invention.

In FIG. 2, the controller 500 also includes an internal address bus AB and an internal data bus DB for connecting the CPU 501 and the respective units, and a hand-shake controller 511 connected between the port units PORT5 and PORT6, and the CPU 501.

FIG. 3 shows memory areas allocated in the ROM 503. Data shown in Table 1 below are developed (stored) in the memory areas.

TABLE 1

| | |
|---|---|
| TCONR | System Clock<br>$TCONR = [(1H/2 - 6)/6]_{HEX}$ |
| CNTBB | 1H Adjustment Parameter in Drive Mode CHPOND<br>$CNTBB = [(1H/2 - 32.5) \times 2]_{HEX}$ |
| CNTL | 1H Adjustment Parameter in Drive Mode LINOND<br>$CNTL = [(1H/2 - 41) \times 2]_{HEX}$ |
| CNTB | 1H Adjustment Parameter in Drive Mode BLKOND<br>$CNTB = [(1H/2 - 20) \times 2]_{HEX}$ |
| DA1 | Scanning Line Voltage<br>$DA1 = [Vcom/17.7 \times 256 - 1]_{HEX}$ |
| DA2 | Information Line Voltage<br>$DA3\ [Vseg/8.7 \times 256 - 1]_{HEX}$ |
| SFCNT | Temperature Compensation Cycle<br>$SFCNT = [30\ sec/(1H \times 400)]_{HEX}$ |

Lower 2 bytes of each address in a temperature compensation look-up table shown in Table 1 coincide with A/D-converted temperature data in consideration of processing efficiency. More specifically, the look-up table shown in FIG. 3 is realized by reading an address obtained by adding a start address of each parameter area to temperature data. In order to perform temperature compensation, data of a drive voltage according to an external temperature and 1H (horizontal scanning period=scanning selection period) are developed.

FIGS. 4, 4A, 4B and 4C shows an arrangement of the data output unit 600. A data input unit 601 is linked to the word processor body 1 to receive the signal D and the transfer clock CLK. The signal D is a sum signal of the image signal and the horizontal sync signal, and is transmitted from the word processor body 1. In this embodiment, real address data is superposed on the horizontal sync signal or the horizontal blanking period, and the superposed signal is supplied. The data input unit 601 switches a data output path in accordance with the presence/absence of detection of the horizontal sync signal or the horizontal blanking period. Upon detection of the horizontal sync signal or the horizontal blanking period, the data input unit 601 recognizes the superposed signal component as the real address data, and outputs it as the real address data RA/D. When the horizontal sync signal or the horizontal blanking period is not detected, the unit 601 recognizes a signal component during this interval as image data, and outputs it as 4-bit parallel image data D0 to D3.

When the data input unit 601 recognizes input of the real address data, it enables the address/data identification signal A/$\overline{D}$. The signal A/$\overline{D}$ is supplied to an $\overline{IRQ}$ generator 603 and a DACT generator 605. The $\overline{IRQ}$ generator 603 outputs the interrupt signal $\overline{IRQ}$ upon reception of the signal A/$\overline{D}$. The signal $\overline{IRQ}$ is supplied to the controller 500 as the interrupt instruction $\overline{IRQ1}$ in accordance with setting at a switch 520 to perform operation in a line access mode or a block access mode. The DACT generator 605 outputs the DACT signal for identifying the presence/absence of access of the display 100 upon reception of the signal A/$\overline{D}$, and supplies it to the controller 500, an $\overline{FEN}$ generator 611, and a gate array 680.

The $\overline{FEN}$ generator 611 generates the signal $\overline{FEN}$ which starts the gate array 680 in accordance with a trigger signal input from an $\overline{FEN}$ trigger generator 613 when the DACT signal is enabled. The $\overline{FEN}$ trigger generator 613 generates a trigger signal in response to a write signal $\overline{ADWR}$ which is output from the controller 500 to cause the A/D converter 950 to fetch temperature information from the thermo sensor 400. In this case, the $\overline{FEN}$ trigger generator 613 is selected by the chip select signal $\overline{DS0}$ generated by a device selector 621. More specifically, when the controller 500 performs chip selection of the A/D converter 950 to fetch temperature data, the $\overline{FEN}$ trigger generator 613 is also selected, and frame drive is started in response to the write signal $\overline{ADWR}$.

A busy gate 619 supplies, to the word processor body 1, a signal BUSY for acknowledging a busy state of the display control apparatus 50 in accordance with the busy signal IBUSY from the controller 500.

The device selector 621 receives the signals A10 to A15 from the controller 500, and outputs the signals $\overline{DS0}$ to $\overline{DS2}$ for performing chip selection of the A/D converter 950, the D/A converter 900, and the data output unit 600 in accordance with the values of the input signals. A register selector 623 is started in response to the signal $\overline{DS2}$, and sets a latch pulse gate array 625 on the basis of the signals A0 to A4 from the controller 500 at that time. The latch pulse gate array 625 selects registers in a register unit 630, and consists of bits corresponding in number to the number of registers in the register unit 630. In this embodiment, the register unit 630 has 22 1-byte areas, and the latch pulse gate array 625 has a 22-bit configuration, each bit of which corresponds to the 1-byte area. More specifically, when the register selector 623 sets bits of the latch pulse gate array 625, the areas corresponding to the set bits are selected, and data read or write access from or to the selected registers is performed through the system data bus in accordance with the read signal $\overline{RD}$ or the write signal $\overline{WR}$ supplied from the controller 500 to the latch pulse gate array 625.

The register unit 630 includes real address data registers RA/DL and RA/DU for respectively storing lower and upper 1-byte data of the real address data RA/D under the control of a real address store controller 641.

Horizontal dot count data registers DCL and DCU respectively store lower and upper 1-byte data of data corresponding to the number of dots (800 dots in this embodiment) in the horizontal scanning direction of the display. A counter 643 for horizontal dot number is started at the beginning of transfer of the image data D0 to D3 to counts clocks. When the counter 643 counts the clocks corresponding to the numerical values stored in the registers DCL and DCU, it causes an $\overline{LATH}$ generator 645 to generate the latch signal $\overline{LATH}$.

A drive mode register DM stores mode data corresponding to the line or block access mode.

Registers DLL and DLU store common line selection address data. Data stored in the register DLL is output as address data CA6 and CA5 for designating a block, and address data CA4 to CA0 for designating a line. Data stored in the register DLU is supplied to a decoder 650 to be output as the chip select signals $\overline{CS0}$ to $\overline{CS7}$ for selecting a common driving element 310.

One-byte areas CL1 and CL2 store drive data to be supplied to the common side driver 300 when common side lines are driven (line write access) in the block access mode. 1-byte areas SL1 and SL2 similarly store drive data to be supplied to the segment side driver 200.

One-byte areas CB1 and CB2 store drive data to be supplied to the common side driver 300 when common side lines are driven upon block erasure in the block access mode. 1-byte areas SB1 and SB2 similarly store drive data to be supplied to the segment side driver 200.

One-byte areas CC1 and CC2 store data to be supplied to the common side driver 300 when common side lines are driven upon line write access in the line access mode. 1-byte areas SC1 and SC2 similarly store drive data to be supplied to the segment side driver 200.

The following three 1-byte areas are areas for storing data for switching the frame driver 700, and are divided in units of 4 bits, so that registers FV1, FCVc, FV2, FV3, FSVc, and FV4 are allocated.

A multiplier 661 multiplies, e.g., doubles, the pulse signal Tout from the controller 500. Ring counters 663A, 663B, 663C, and 663D respectively count 3-, 4-, 6-, and 12-phase outputs of the multiplier 661, and are respectively used for dividing one horizontal scanning period (1H) by 4, 3, 2, and 1. The divided period will be referred to as ΔT hereinafter. For example, when the 1H is divided by 3, 3ΔT defines the 1H.

A multiplexer 665 selects one of the outputs from the ring counters 663A to 663D, and is set in accordance with the content of the drive mode register DM, i.e., data indicating the number of divisions of the 1H. For example, if the number of divisions is 3, the multiplexer 665 selects the output from the 4-phase ring counter 663B.

A 4-phase ring counter 667 counts the outputs from the ring counters 663A to 663D. A multiplexer 669 is set in the same manner as the multiplexer 665.

Figure 6:
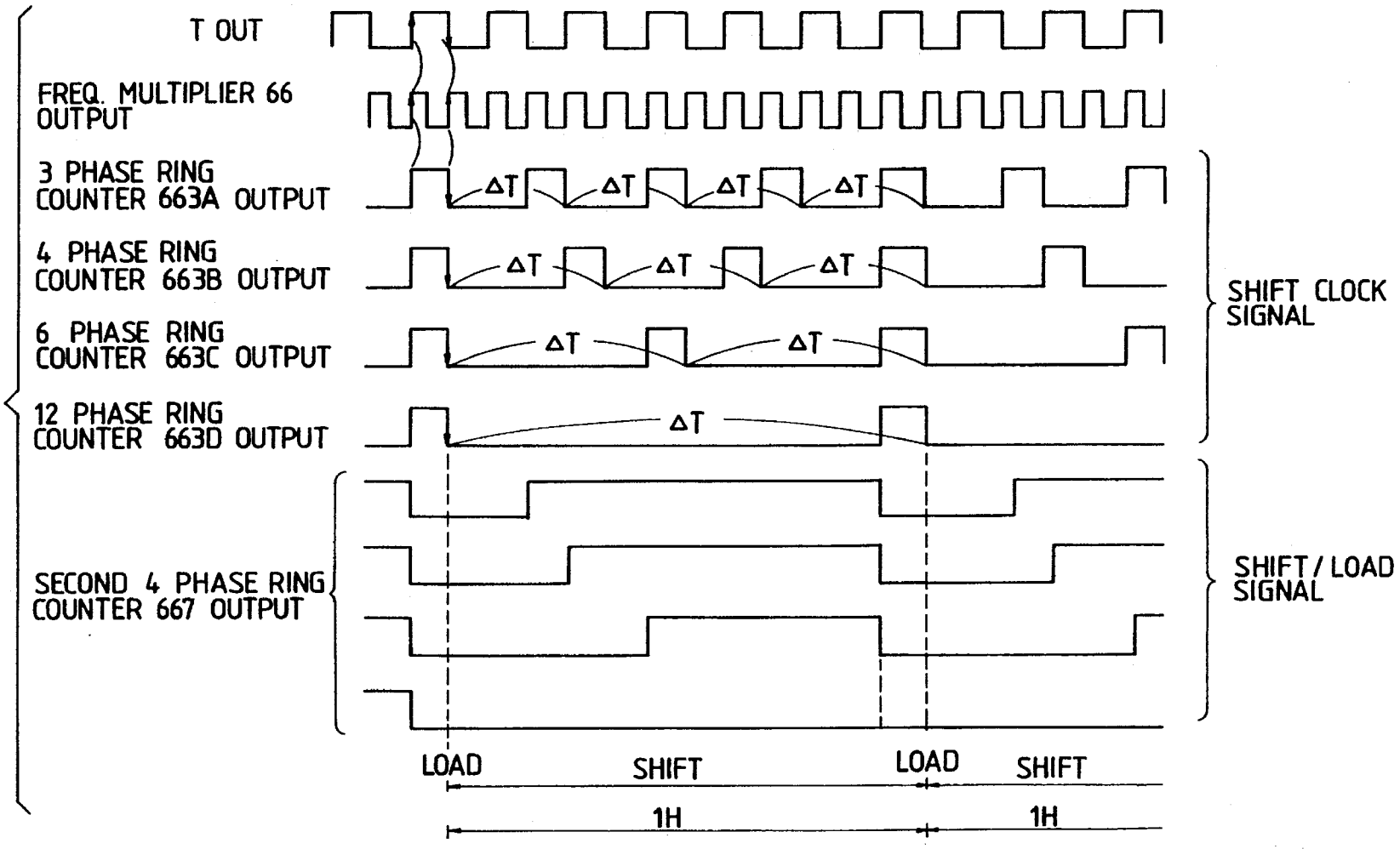
FIG. 6 is a waveform chart of clock signals used in the present invention.

FIG. 6 shows the clock Tout, the output waveform of the multiplexer 661, and the output waveforms of the ring counters 663A to 663D and 667. More specifically, when the multiplexer 665 selects one of the outputs from the ring counters 663A to 663D, one of 4ΔT/1H, 3ΔT/1H, 2ΔT/1H, and ΔT/1H is selected, and its output waveform is supplied to a shift register unit 673 as a shift clock, thus outputting ON/OFF data for every ΔT. One of the outputs from the 4-phase ring counter 667 is selected by the multiplexer 669, and its output waveform is supplied to the shift register unit 673 as a shift load signal, thus setting an operation based on the selected number of divisions.

Referring again to FIG. 4, the areas CL1, CB1, and CC1 of the register unit 630 store ON/OFF data for every ΔT of the clear signal $\overline{\text{CCLR}}$ and the enable signal CEN to be supplied to the common side driver 300. The areas CL2, CB2, and CC2 similarly store ON/OFF data for every ΔT of the drive waveform defining signals CM1 and CM2. The areas SL1, SB1, and SC1 store ON/OFF state for every ΔT of the clear signal $\overline{\text{SCLR}}$ and the enable signal SEN to be supplied to the segment side driver 200. The areas SL2, SB2, and SC2 similarly store ON/OFF data for every ΔT of the waveform defining signals SM1 and SM2.

In this embodiment, a storage area for each signal data has a 4-bit configuration, and 1 bit corresponds to ON/OFF data of 1ΔT. More specifically, in this embodiment, the maximum number of divisions of 1H is 4.

A multiplexer unit 671 is linked to the areas CL1 to SC2. The multiplexer unit 671 selects one of signal data in line write access and block erasure access in the block access mode and the line write access in the line access mode in accordance with the content of the drive mode register DM. The multiplexer unit 671 includes a multiplexer MPX1 for selecting 4-bit data for the signal $\overline{\text{CCLR}}$ from the areas CL1, CB1, and CC1, a multiplexer MPX2 for similarly selecting 4-bit data for the signal CEN, a multiplexer MPX3 for selecting 4-bit data for the signal CM1 from the areas CL2, CB2, and CC2, and a multiplexer MPX4 for similarly selecting 4-bit data for the signal CM2. The multiplexer unit 671 also includes a multiplexer MFX5 for selecting 4-bit data for the signal $\overline{\text{SCLR}}$ from the areas SL1, SB1, and SC1, a multiplexer MPX6 for similarly selecting 4-bit data for the signal SEN, a multiplexer MPX7 for selecting 4-bit data for the signal SM1 from the areas SL2, SB2, and SC2, and a multiplexer MPX8 for similarly selecting 4-bit data for the signal SM2.

The shift register unit 673 includes shift registers P/S1 to P/S8 for parallel/serial (P/S) conversion linked to the multiplexers MPX1 to MPX8 of the multiplexer unit 671, respectively. The shift register unit 673 receives the output from the multiplexer 665 as a shift clock signal, and defines an output period ΔT of the 1-bit ON/OFF data. The unit 673 also receives the output from the multiplexer 669 as a preset signal for performing an operation with the preset number of divisions.

A multiplexer unit 675 includes multiplexers MPX11 to MPX18 linked to the shift registers P/S1 to P/S8, respectively. The unit 675 outputs P/S-converted ON/OFF data on the basis of bit selection data (stored in the register DM) of the 4-bit ON/OFF data of the signals stored in the registers CL1 to SC2.

An output unit 677 performs the same processing as in the shift register unit 673 and the multiplexer unit 675 for the registers FV1, FCVc, FV2, FV3, FSVc, and FV4. A gate array 680 is enabled in accordance with the signals DACT and $\overline{\text{FEN}}$ to supply the switch signals $\overline{\text{V1}}$ to $\overline{\text{V4}}$, $\overline{\text{CVc}}$, and $\overline{\text{SVc}}$ to the frame driver 700.

An MR generator 690 supplies the signal MR to the controller 500 when the chip select signal DS1 of the D/A converter 900 is enabled, i.e., when the D/A converter 900 is accessed, thereby changing a pulse width of the clock E generated by the CPU 501.

Figure 5:
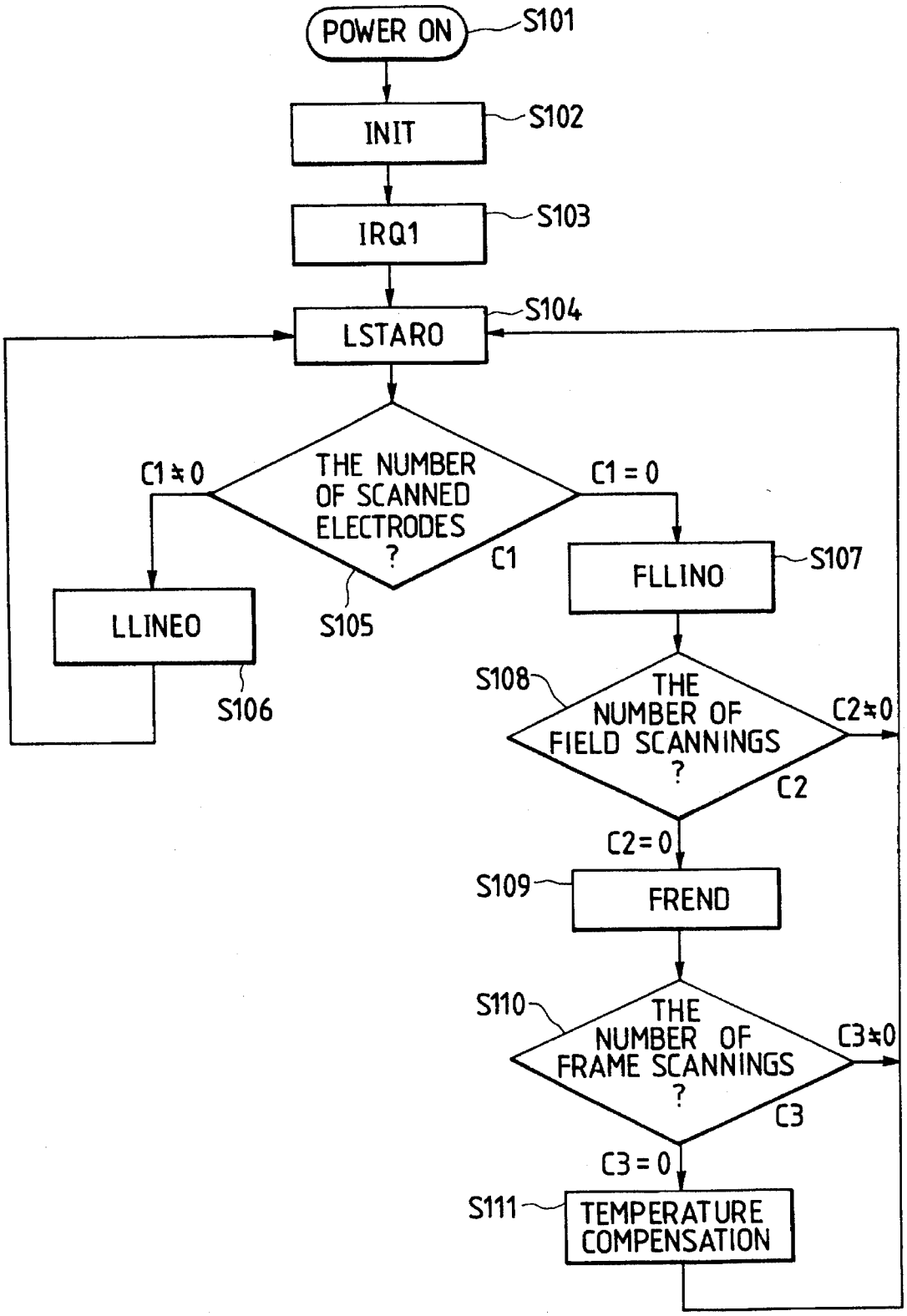
FIG. 5 is a flow chart showing an information processing procedure used in the present invention.

FIG. 5 shows a program flow of a display control mode. Display control of this embodiment will be briefly described below with reference to FIG. 5.

In FIG. 5, when the power switch of the word processor body 1 is set "ON", an INIT routine is automatically started (step S101). In this step, the Busy signal is set to "ON" to perform temperature compensation upon power-on. Finally, the Busy signal is set to "OFF", and the control waits until the interrupt request $\overline{\text{IRQ1}}$ is input (step S102). The interrupt request $\overline{\text{IRQ1}}$ is generated when address data is transferred from the word processor body 1. If no address data is input, the program is not executed, and the display screen 102 is left unchanged.

When the address data is transferred and the interrupt request $\overline{\text{IRQ1}}$ is generated, the control advances to an LSTART routine in accordance with the procedure in step S102.

When the request $\overline{\text{IRQ1}}$ is generated by the line access mode, the LSTART routine is started, and the corresponding program is executed. In this routine, the transferred address data is loaded from the data output unit 600, and it is checked if this address corresponds to the final line of the effective display region 104 (step S104). If it is determined that the address does not correspond to the final line, program execution branches to an LLINE routine (step S106). In this routine, the Busy signal is set to "ON", and line write access for one scanning line is performed on the basis of the image data following the address data. Then, the Busy signal is set to "OFF", and the control waits for the interrupt request $\overline{\text{IRQ1}}$ (step S105). When the request signal $\overline{\text{IRQ1}}$ is supplied, the LSTART routine is started again.

If it is determined in step S105 that the address data corresponds to the final line, program execution branches to an FLLINE routine. In this routine, line write access of the final line is performed on the basis of the transferred image data. Frame driving and temperature compensation data are then updated, and the Busy signal is set to "OFF" to wait for the interrupt request $\overline{\text{IRQ1}}$ (step S105). If the interrupt request $\overline{\text{IRQ1}}$ is input, the LSTART routine is started again. With the above-mentioned procedure, display control in the line access mode is performed.

According to the present invention, when a period in units of several tens of seconds is determined using a line counter, several ten thousands of lines must be counted to obtain one scanning selection period. In this embodiment, display control is performed using three associated counters. The three counters are respectively used to determine a frame driving period, an inter-unit correction period, and a temperature compensation period in display control.

A first counter C1 is a down counter for determining a frame driving timing. The counter C1 is initialized to a predetermined value in accordance with a temperature, and is decremented by one for each line scanning. A frame driving operation is performed when the counter value becomes zero, and at that time, the counter is reset. The initial value of the counter according to a temperature is set in temperature compensation.

A second counter C2 is a down counter for determining a timing of inter-unit temperature compensation table correction. The counter C2 is initialized to a predetermined value in accordance with a temperature, and is decremented every time the first counter C1 becomes zero, thereby counting the number of field scannings. When the second counter C2 becomes zero, a dip switch for inter-unit correction is read to calculate an offset value for performing temperature compensation table correction. Then, a driving condition reflecting the offset value is set. The counter is then reset.

A third counter C3 is a down counter for determining a temperature compensation timing. The counter C3 is initialized to a predetermined value in accordance with a temperature, and is decremented every time the second counter C2 becomes zero, thus counting the number of frame scannings. When the third counter C3 becomes zero, the output from the temperature sensor is A/D-converted, and the driving condition is set on the basis of this temperature data. The counter is then reset.

The first and second counters C1 and C2 are set as follows. That is, if the first counter C1 is represented by m and the second counter C2 is represented by n, a product of m and n coincides with the number of scanning lines forming one frame. The third counter C3 is read from the look-up table shown in FIG. 3 so that even if one scanning selection period changes due to a change in temperature, waveform setting by temperature compensation is performed at almost a constant cycle over the entire operation temperature range of the display. For example, if the following liquid crystal display apparatus is assumed, the number of lines is set as shown in Table 2 below at respective temperatures.

TABLE 2

| Liquid Crystal Display Apparatus<br>Number of Scanning Lines . . . 400<br>Temperature Compensation Period . . . every 30 sec | | | |
|---|---|---|---|
| Temperature | 5° C. | 25° C. | 40° C. |
| 1 Line Scanning Period | 700 μs | 250 μs | 120 μs |
| m | 25 lines | 50 lines | 50 lines |
| n | 16 fields | 8 fields | 8 fields |
| k | 107 frames | 300 frames | 625 frames |

In this embodiment, as shown in Table 2, at 40° C., every time 50 lines are counted, the control advances to a frame driving routine; 8 fields, an inter-unit correction routine; and 625 frames, a temperature compensation routine. However, at a temperature of 5° C., every time 25 lines are counted, the control advances to the frame driving routine; 16 fields, the inter-unit correction routine; and 107 frames, the temperature compensation routine.

Figure 9:
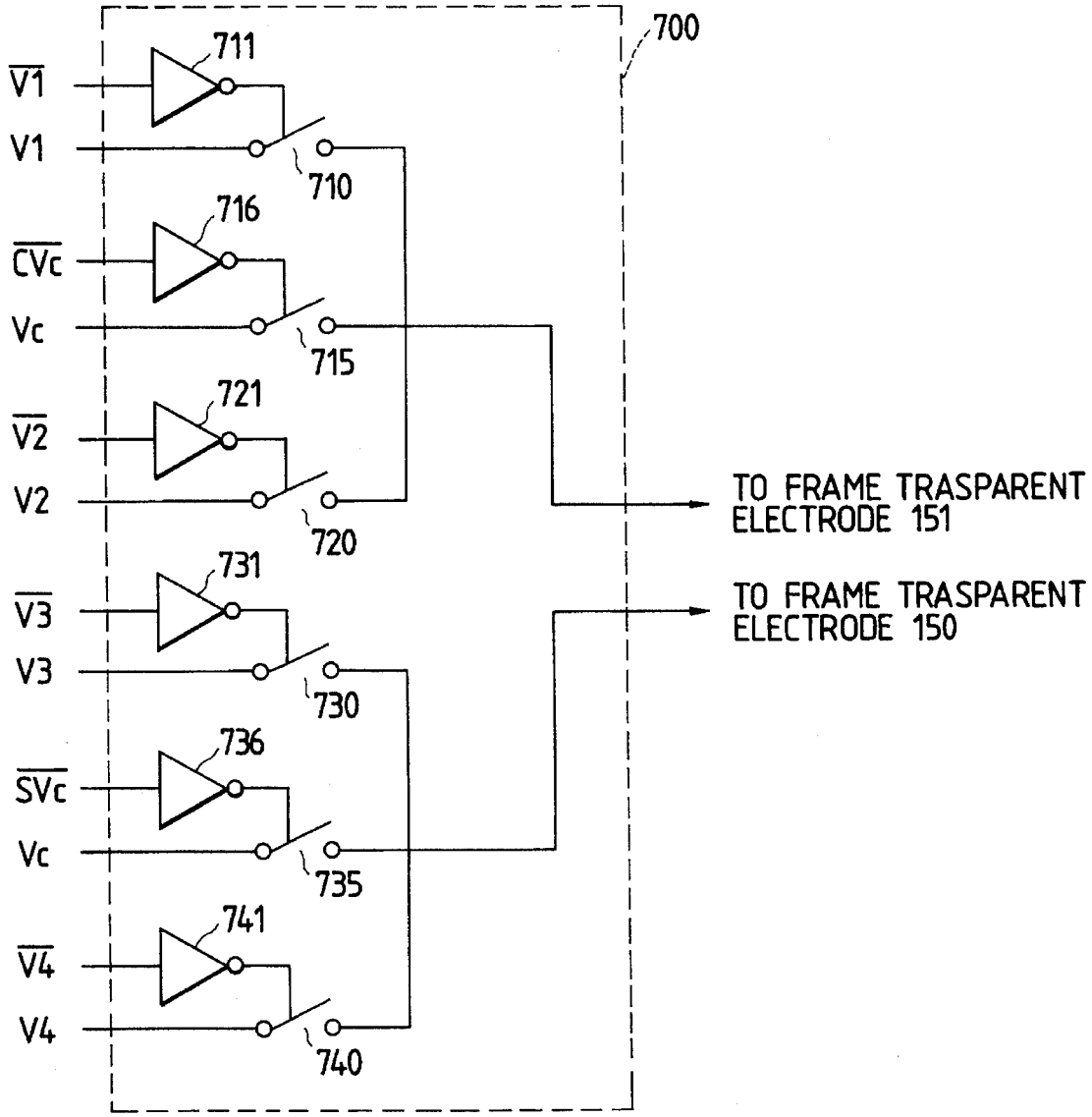
FIG. 9 is a block diagram showing a frame driver used in the present invention.
Figure 10:
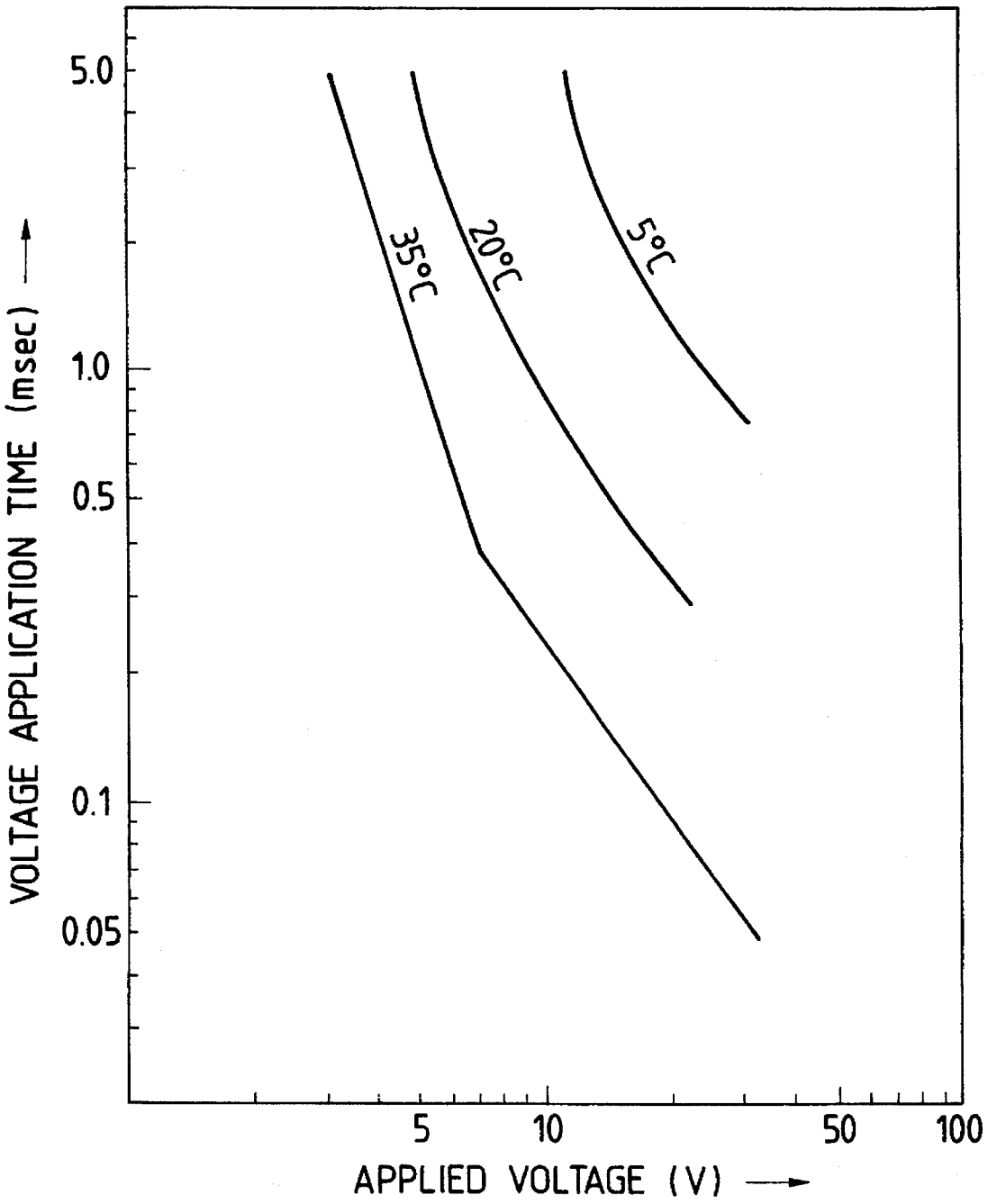
FIG. 10 is a graph showing temperature dependency of a DOBAMBC as a ferroelectric liquid crystal compound with respect to threshold characteristics.

FIG. 9 shows an arrangement of the frame driver 700. The frame driver 700 includes switches 710, 715, 720, 730, 735, and 740 for respectively turning on/off supply paths of the voltage signals V1, VC, V2, V3, VC, and V4. These switches are controlled by the switch signals $\overline{V1}$, $\overline{CVc}$, $\overline{V2}$, $\overline{V3}$, $\overline{SVc}$, and $\overline{V4}$ supplied from the gate array 680 of the data output unit 600 respectively through inverters 711, 716, 721, 731, 736, and 741.

Upon frame driving, the switches 710, 715, and 720 are switched in accordance with the contents of the registers FV1, FCVc, and FV2 allocated in the register unit 630 of the data output unit 600, i.e., the states of the signals $\overline{V1}$, $\overline{CVc}$, and $\overline{V2}$, so that a waveform signal selectively having a value of V1, VC, or V2 can be applied to a frame transparent electrode 151 parallel to the common line. The switches 730, 735, and 740 are switched in accordance with the contents of the registers FV3, FSVc, and FV4, i.e., the states of the signals $\overline{V3}$, $\overline{SVc}$, and $\overline{V4}$, so that a waveform signal selectively having a value of V3, VC, or V4 can be applied to a frame transparent electrode 150 parallel to the segment line.

Inter-unit correction is performed to set a driving condition to a predetermined correction value since a driving condition varies in units of display units due to a variation in a manufacturing process.

Figure 8A:
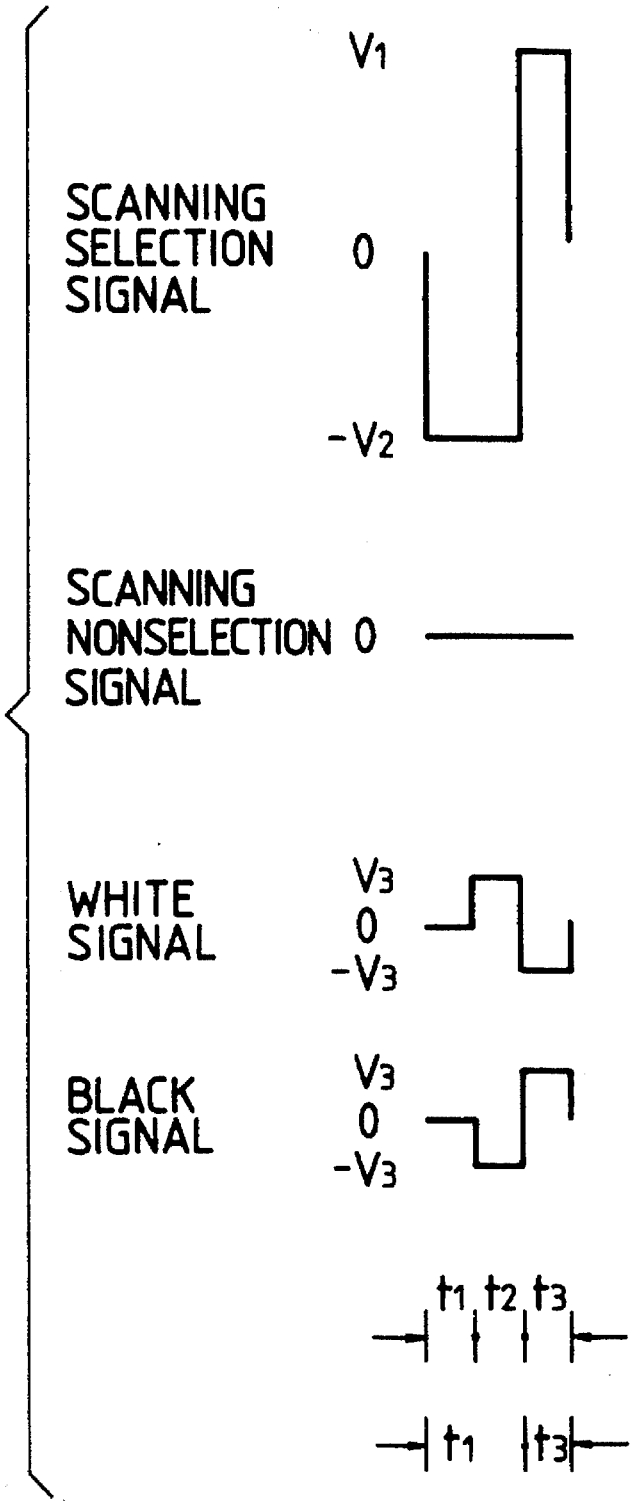
FIGS. 8A to 8E are driving waveform charts used in the present invention.

FIGS. 8A to 8E show drive waveforms used in the present invention. FIG. 8A shows a scanning selection signal, a scanning nonselection signal, a white information signal, and a black information signal. When the white information signal is applied from an information electrode to a pixel on a scanning electrode to which the scanning selection signal is applied, the pixel is erased to a black state in a phase $T_1$ (erased to the black state upon application of a voltage $V_2$ in a phase $t_1$ and a voltage of $V_3+V_2$ in a phase $t_2$). In the next phase $t_3$, a voltage of $V_1+V_3$ is applied, and the pixel is written in a white state. On the other hand, when the black information signal is applied from the information electrode to a pixel on the same scanning electrode, the pixel is erased to the black state in the phase $T_1$ (erased to the black state upon application of a voltage $V_2$ in a phase $t_1$ and a voltage of $-V_3+V_2$ in a phase $t_2$), and is applied with a voltage of $V_3-V_1$ in the next phase $t_3$, so that the immediately preceding black state is maintained and the pixel is written in the black state.

Figure 8B:
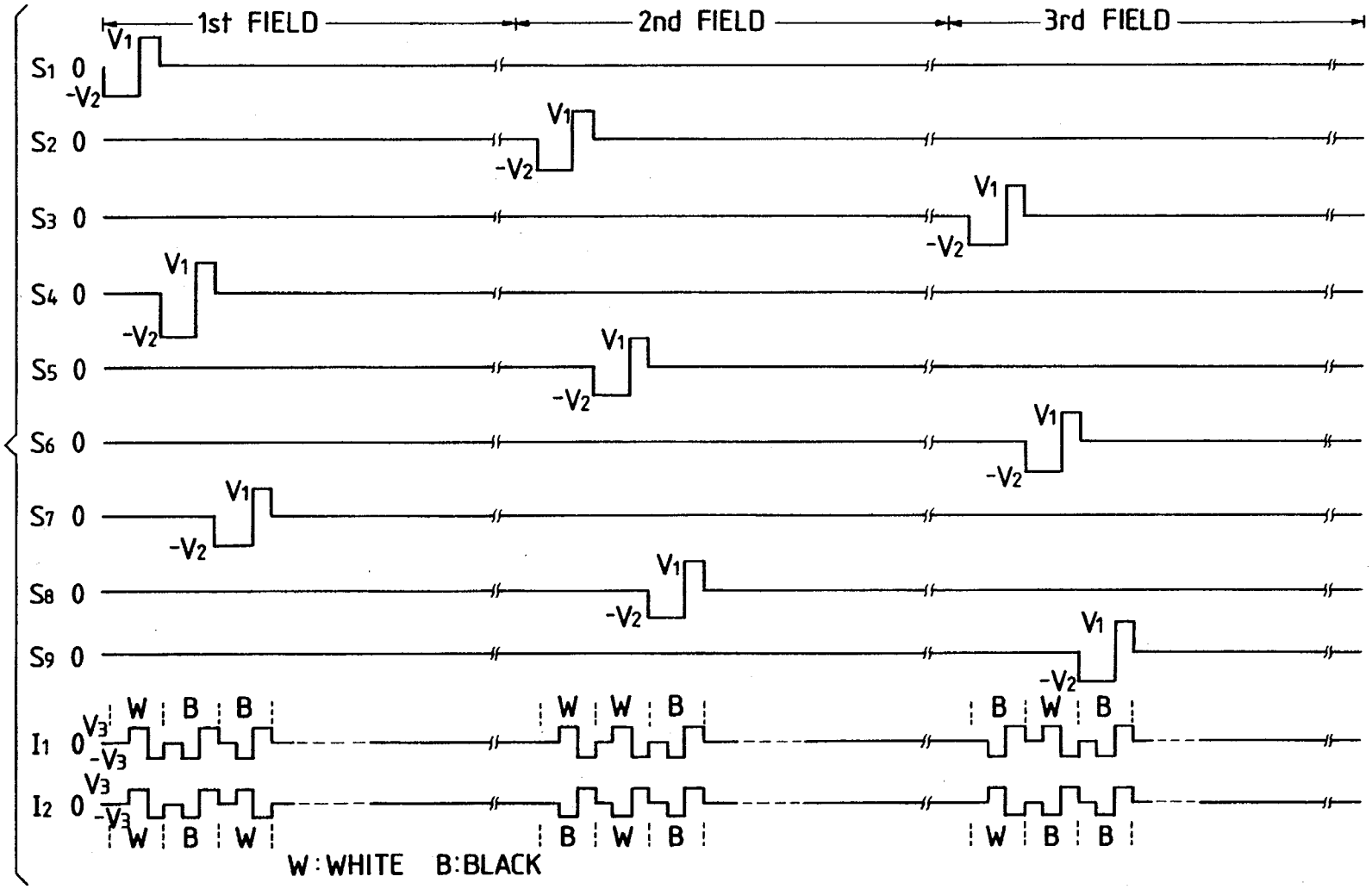

In this embodiment, the above-mentioned scanning selection signal is applied to every third or more scanning electrodes. FIG. 8B exemplifies a case wherein the scanning selection signal is applied to every third scanning electrodes.

Figure 8C:
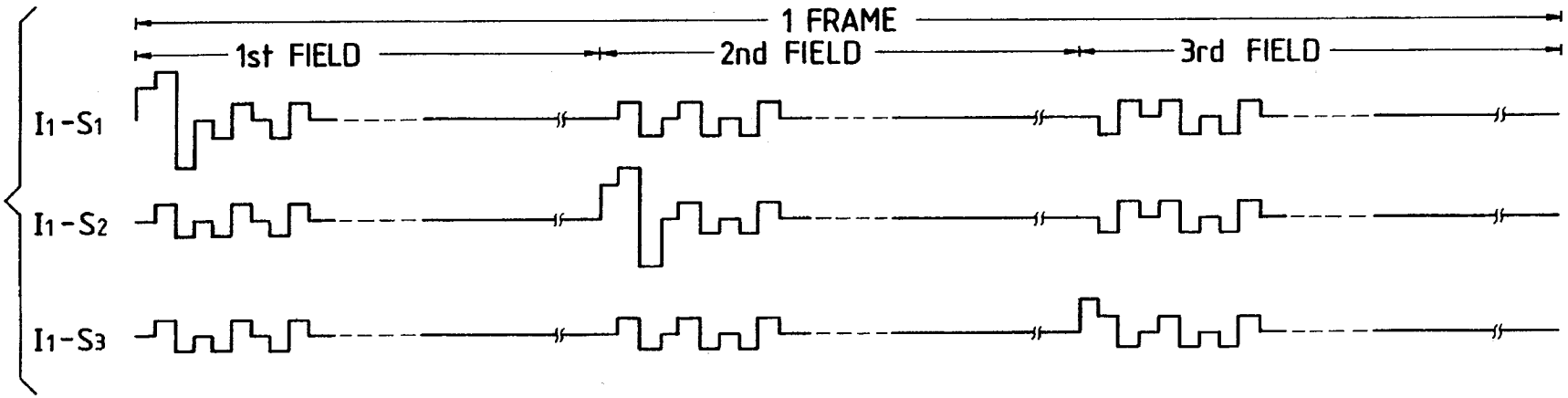

FIG. 8C shows a voltage waveform to be applied to a ferroelectric liquid crystal pixel.

In the above embodiment, every third scanning electrodes are selected. However, the present invention is not limited to such an interlace selection method of selecting every third scanning electrodes. For example, interlace selection methods of selecting every fourth, fifth, or (N+1)th scanning electrodes may be employed (the number of field scannings at that time is N+1). Especially, in the present invention, an interlace selection method of selecting every ninth scanning electrodes is effective to suppress a flicker.

Figure 8D:
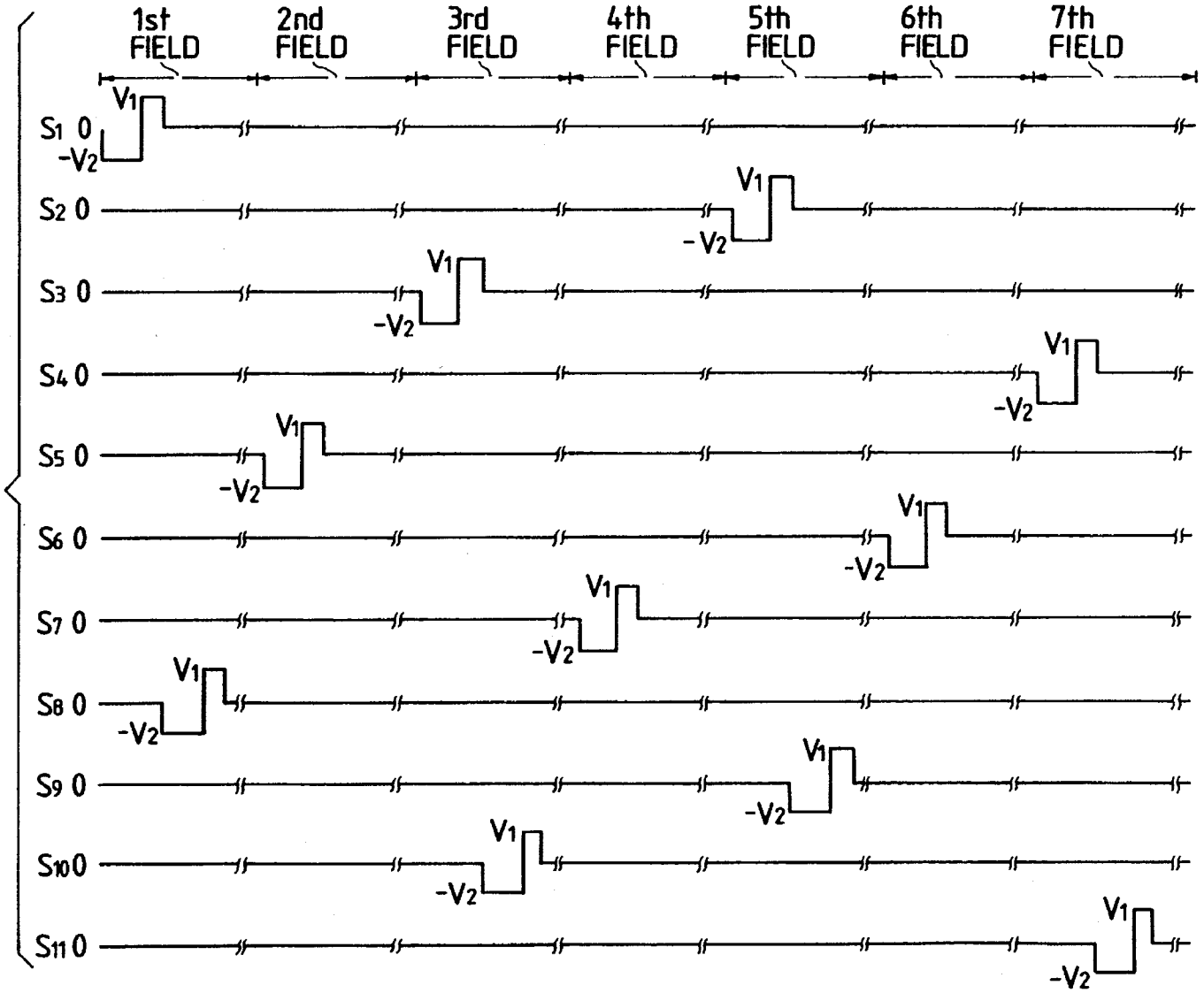
Figure 8E:
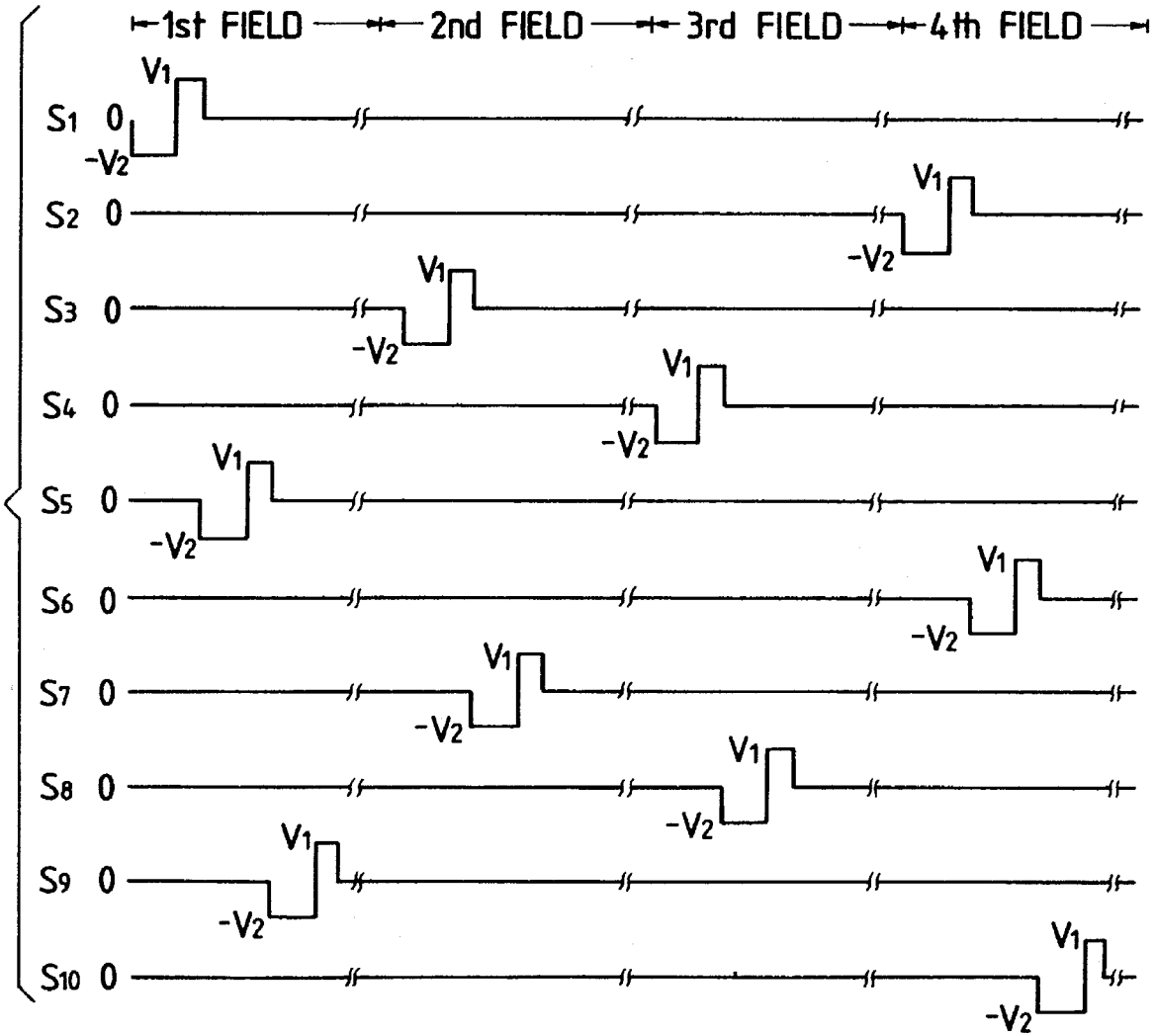

FIGS. 8D and 8E show more preferable examples. In a drive example shown in FIG. 8D, the scanning selection signal is applied to every seventh scanning electrodes. More specifically, the scanning selection signal is applied to 1st (F+1)th, 5th (F+5)th, 3rd (F+3)th, 7th (F+7)th, 2nd (F+2)th, 6th (F+6)th, and 4th (F+4)th scanning electrodes in the order of 1st, 2nd, . . . , 7th fields (the number of field scannings is represented by F). That is, the application order of scanning signals does not coincide with the order of lines in correspondence with the field order. According to the drive example shown in FIG. 8D, the scanning selection signal is applied to non-adjacent scanning electrodes in continuous seven fields constituting one frame scanning. FIG. 8E shows another example (interlace selection method of selecting every fourth electrodes). The drive examples shown in FIGS. 8D and 8E are more effective in terms of flicker suppression than in a case of the scanning signal application method shown in FIG. 8B.

In the present invention, various types of ferroelectric liquid crystal elements can be employed. More specifically, an SSFLC disclosed in U.S. Pat. No. 4,367,924 (Clark et al.), a ferroelectric liquid crystal element in an orientation state having a helical residue disclosed in U.S. Pat. No. 4,586,791 (Isogai et al.), or a ferroelectric liquid crystal element disclosed in UK Patent Application No. 2,159,635 may be used.

According to the present invention, even if an external temperature abruptly changes, display driving control at that temperature can be compensated, and a flicker occurring in a display driving operation at a low temperature can be effectively suppressed.

What is claimed is:

1. A liquid crystal apparatus comprising:

a liquid crystal display having matrix electrodes including scanning electrodes and information electrodes;

driving means including means for applying a scanning selection signal to said scanning electrodes at a controlled driving frequency and means for applying information signals to said information electrodes in synchronism with the scanning selection signal, the information signals being organized in fields and a plurality of fields corresponding to a frame; and control means for controlling the driving frequency of said driving means, in a time sharing manner, said control means comprising means for setting a first number of scanning electrodes to be scanned per field and a second number of fields to correspond to each frame, and means for changing, in dependence upon an external temperature, the first and second numbers.

2. An apparatus according to claim 1, wherein said driving means applies the scanning selection signal to every third or more scanning electrodes during one field so as to perform an interlace operation of at least 3:1.

3. An apparatus according to claim 2, wherein said driving means applies the scanning selection signal to said scanning electrodes such that a group of adjacent scanning electrodes are scanned during at least three consecutive fields in such an order that adjacent scanning electrodes are not scanned in successive fields.

4. An apparatus according to any of claims 1 to 3, wherein the scanning selection signal is a signal having voltage levels in positive and negative directions with reference to an application voltage of a scanning nonselection signal.

5. An apparatus according to claim 1, wherein the first and second numbers are set so that a lower temperature value is less than a higher temperature value.

6. An apparatus according to claim 1, further comprising:

means for executing a temperature detecting operation.

7. An apparatus according to claim 6, further comprising:

means for performing the temperature detecting operation in accordance with a counted timing.

8. An apparatus according to claim 1, wherein said liquid crystal display is a ferroelectric liquid crystal display.

9. A liquid crystal device comprising:

a liquid crystal panel having a matrix display comprising scanning electrodes, information electrodes and liquid crystal;

a driving means for supplying a scanning selection signal to the scanning electrodes, and for supplying an information signal to the information electrodes synchronously with the scanning selection signal; and a control means for controlling said driving means such that at least two scanning electrodes are skipped between each pair of scanning electrodes to which the scanning selection signal is applied;

wherein the number of scanning electrodes that are skipped between each pair of scanning electrodes is changed in accordance with an external temperature.

10. A liquid crystal device according to claim 9, wherein said control means comprises a temperature detection means for detecting the external temperature according to a counted timing.

11. A liquid crystal device according to claim 9, wherein the liquid crystal is a ferroelectric liquid crystal.

12. A liquid crystal device comprising:

a liquid crystal panel having a matrix display comprised of scanning electrodes, information electrodes and liquid crystal;

a driving means for supplying a scanning selection signal to the scanning electrodes, and for supplying an information signal to the information electrodes synchronously with the scanning selection signal; and a control means for controlling said driving means such that at least two scanning electrodes are skipped between each pair of scanning electrodes to which the scanning selection signal is applied;

wherein the number of scanning electrodes that are skipped between each pair of scanning electrodes is changed in accordance with an external temperature, such that the number of scanning electrodes that are skipped increases as the external temperature decreases.

13. A liquid crystal device according to claim 12, wherein said control means comprises a temperature detection means for detecting the external temperature in accordance with a counted timing.

14. A liquid crystal device according to claim 12, wherein the liquid crystal is a ferroelectric liquid crystal.

* * * * *

UNITED STATES PATENT AND TRADEMARK OFFICE

CERTIFICATE OF CORRECTION

PATENT NO. : 5,506,600

DATED : April 9, 1996

INVENTOR(S) : AKIKO OOKI ET AL.

It is certified that error appears in the above-identified patent and that said Letters Patent is hereby corrected as shown below:

TITLE PAGE

AT [56] REFERENCES CITED

U.S. Patent Documents, insert

| | | | |
|---|---|---|---|
| --4,697,887 | 10/1987 | S. Okada, et al. ..... | 350/350 |
| 4,709,995 | 12/1987 | M. Kuribayashi, et al. .. | 350/350 |
| 4,367,924 | 1/1983 | N. Clark, et al. ..... | 350/334 |
| 4,712,872 | 12/1987 | J. Kanbe, et al. ..... | 350/333 |
| 4,548,476 | 10/1985 | S. Kaneko ..... | 350/350 |
| 4,586,791 | 5/1986 | M. Isogai, et al. ..... | 350/341 |
| 4,655,561 | 4/1987 | J. Kanbe ..... | 350/350 |

Foreign Patent Documents, insert

| | | | |
|---|---|---|---|
| -- 0149899 | 7/1985 | European Patent Office ... | 3/36 |
| 56-107216 | 8/1981 | Japan ..... | 001/13 |
| 2159635 | 12/1985 | United Kingdom ..... | 1/13-- |

Other Publications, insert

--Applied Physics Letters, Vol. 18, No. 4, Feb. 15, 197
M. Schadt, et al., "Voltage-Dependent Optical Activit
of a Twisted Nematic Liquid Crystal"--.

COLUMN 3

Line 55, "diving" should read --driving--.

COLUMN 5

Line 14, "INTR" should read --$\overline{\text{INTR}}$--.
Line 29, "WR" should read --$\overline{\text{WR}}$--.

UNITED STATES PATENT AND TRADEMARK OFFICE

CERTIFICATE OF CORRECTION

PATENT NO. : 5,506,600

DATED : April 9, 1996

INVENTOR(S) : AKIKO OOKI ET AL.

It is certified that error appears in the above-identified patent and that said Letters Patent is hereby corrected as shown below:

COLUMN 7

Line 12, "CCLR" should read --$\overline{\text{CCLR}}$--.

Signed and Sealed this

First Day of October, 1996

*Attest:*

*Attesting Officer*

BRUCE LEHMAN

*Commissioner of Patents and Trademarks*